United States Patent [19]

Teranishi et al.

[11] Patent Number: 4,615,493

[45] Date of Patent: Oct. 7, 1986

[54] METHOD FOR DOFFING PACKAGES FROM A WINDING MACHINE AND AN APPARATUS FOR EFFECTING THE SAME

[75] Inventors: Akio Teranishi; Tsuneo Murakami, both of Iwakuni, Japan

[73] Assignee: Teijin Seiki Co. Ltd., Osaka, Japan

[21] Appl. No.: 612,616

[22] Filed: May 21, 1984

Related U.S. Application Data

[63] Continuation-in-part of Ser. No. 552,979, Nov. 17, 1983, abandoned.

[30] Foreign Application Priority Data

Nov. 20, 1982 [JP] Japan ..... 57-202878

[51] Int. Cl.[4] ..... B65H 54/26; B65H 67/04

[52] U.S. Cl. ..... 242/35.5 A

[58] Field of Search ..... 242/35.5 A, 35.5 R, 242/35.6 R; 57/268, 270; 901/3, 4, 5, 6

[56] References Cited

U.S. PATENT DOCUMENTS

| | | | |
|---|---|---|---|
| 3,791,126 | 2/1974 | Kose et al. | 242/35.5 A X |
| 3,811,631 | 5/1974 | Mayer et al. | 242/35.5 A X |
| 3,820,730 | 6/1974 | Endo et al. | 242/35.5 A X |
| 3,971,520 | 7/1976 | Shimai | 242/35.5 A |
| 3,987,974 | 10/1976 | Mayer | 242/35.5 A |
| 4,007,882 | 2/1977 | Isoard | 242/35.5 A X |
| 4,069,983 | 1/1978 | Muramatsu et al. | 242/35.5 A X |
| 4,116,395 | 9/1978 | Courvoisier | 242/35.5 A |
| 4,139,162 | 2/1979 | Stahlecker | 242/35.5 A |
| 4,335,859 | 6/1982 | Courvoisier | 242/35.5 A |
| 4,340,187 | 7/1982 | Schippers et al. | 242/35.5 A |
| 4,427,158 | 1/1984 | Conrad | 242/35.5 A |

FOREIGN PATENT DOCUMENTS

| | | | |
|---|---|---|---|
| 3325999 | 1/1984 | Fed. Rep. of Germany | 242/35.5 A |
| 113662 | 9/1981 | Japan | 242/35.5 A |
| 2039552 | 8/1980 | United Kingdom | 242/35.5 A |

*Primary Examiner*—Stanley N. Gilreath

*Attorney, Agent, or Firm*—Burgess, Ryan & Wayne

[57] ABSTRACT

A method for doffing packages from a winding machine having a plurality of work stations disposed along the lengthwise direction of a machine frame, wherein reference points have been previously memorized for said respective work stations, a doffing truck is moved to a location in front of one of said work positions, and a series of doffing operations to the work station take place based on said reference point memorized with respect to said work station, and an apparatus for effecting the same.

12 Claims, 60 Drawing Figures

FIG. 32(ℓ)

METHOD FOR DOFFING PACKAGES FROM A WINDING MACHINE AND AN APPARATUS FOR EFFECTING THE SAME

RELATED APPLICATIONS

This application is a continuation-in-part of U.S. Ser. No. 552,979 filed Nov. 17, 1983, now abandoned, the contents of which are incorporated by reference.

TECHNICAL FIELD OF THE INVENTION

This invention relates to a method for doffing packages from a winding machine having a plurality of work stations disposed along the lengthwise direction of a machine frame and an apparatus for effecting the same.

In a winding machine, such as a draw texturing machine (DTY machine), a draw twister (DT machine), a twisting machine, a doubling machine, a rewinding machine, a yarn winding machine, a machine for winding film, a machine for winding glass fibers, a machine for winding metal fibers, a machine for winding electric wires, a plurality of work stations are disposed along the lengthwise direction of the machine. When a package is wound up by means of such a winding machine, the full package is doffed and an empty bobbin is donned to further continue the winding operation.

The winding machines are classified into two types: a type wherein all the work stations are provided with vertical spindles so that bobbins for winding yarns thereonto are vertically supported by the spindles; and the other type wherein bobbins for winding yarns thereonto are substantially horizontally supported by cradles. The present invention is applicable to both types. Especially, the present invention is preferable to be used as an apparatus for doffing full packages from a winding machine wherein bobbins are substantially horizontally supported by cradles.

DESCRIPTION OF THE PRIOR ART

Conventional apparatuses for doffing full packages and donning empty bobbins are roughly classified into two types:

a so called simultaneous type doffer which is installed on a machine frame and which simultaneously doffs all full packages from the machine frame;

a so called movable type doffer wherein a truck moves along a machine frame and which sequentially doffs full packages and dons empty bobbins.

The simultaneous type doffer requires disposing doffing equipments at all the work stations and, accordingly, the costs of the equipment are high. In addition, it is very difficult to install such a simultaneous type doffer to a machine which has already been installed, such as a DTY machine, and which was designed without taking into consideration the installation of such auto doffing apparatus. Further, when the doffed packages are subjected to operations for adhering tapes for identifying the spindle numbers, for fixing tails of yarn ends, for forming leading ends of yarns and inspections of dirt or fluff, full bobbins must be manually transferred to bobbin transferring trucks prepared for the above-described operations and inspections when the simultaneous type doffer is applied to the doffing operation.

Contrary to this, a movable type doffer can readily be used as a doffing apparatus of a machine which has been installed. Further it is possible for a movable type doffer to insert full bobbins to peg type bobbin installing stands at the time when they are doffed. In addition, a movable type doffer is superior to a simultaneous type doffer in that a plurality of spindles can be processed by one doffer.

The present invention relates to a movable type doffer among the above-described two type doffers.

The following explanation will now be done with reference to a movable doffer of a draw texturing machine.

As is well known, in a draw texturing machine, a plurality of, for example, about one hundred for one side, work stations are disposed along the lengthwise direction of the machine frame, and each work station comprises a plurality of, usually two or three, winding devices, which are so called spindles and which are vertically superimposed.

Many auto doffers have conventionally been known, for example, from U.S. Pat. No. 4,079,898, which move along a machine frame of a draw texturing machine and which automatically doff full bobbins and don empty bobbins.

However, generally speaking, in winding machines, including draw texturing machines, although the precisions in prefabrication of each winding devices are sufficiently high, the relative locational relationships between the winding devices, especially between those belonging to different work stations, are not taken into consideration. For example, if the heights from the floor on which the machine frame is installed or the distances from the working area are measured, there can be observed a large variation between the work stations.

The above-mentioned auto doffer repeats its movement and stoppage along the lengthwise direction of the machine frame and also repeats its doffing operations, which are entirely the same at all the work stations, based on the location where it stops.

As described above, a conventional winding machine per se has large variation between its work stations, and accordingly, the locations, based on which the operations start, are not identical between the work stations. Therefore, doffing operations cannot be assured.

In order to assure the doffing operation, when an auto doffer such as described above is intended to be used in a conventional winding machine, the floor on which the winding machine is installed is flattened first, and then base rails are disposed with high precision at the locations where the auto doffer moves. Further, the winding machine is reconstructed so that both the preciseness in the relative locational relationships between winding devices disposed along the lengthwise direction of the winding machine and the preciseness of the prefabrication of the winding devices are enhanced.

As a result, when a conventional auto doffer is intended to be used, a very large reconstruction and a lot of costs for reconstruction are required. Therefore, the conventional auto doffers have not been practically used. A bobbin changing apparatus is disclosed in U.S. Pat. No. 4,340,187 and a bobbin transport apparatus is disclosed in U.S. Pat. No. 4,351,494 which are incorporated herein by reference.

OBJECTS OF THE INVENTION

An object of the present invention is to provide a method for doffing packages from a winding machine having a plurality of work stations disposed along the lengthwise direction of a machine frame and an apparatus for effecting the same, which method and apparatus can be applied for a machine which has been installed without requiring a large reconstruction or a lot of costs for reconstruction which are inherent to the prior art.

Another object of the present invention is provide a method and an apparatus, which can readily respond to the changes in the locations of the work stations, on the machine.

SUMMARY OF THE INVENTION

According to the present invention, the objects are achieved by a method for doffing packages from a winding machine having a plurality of work stations disposed along the lengthwise direction of a machine frame, wherein reference points have been previously memorized for the respective work stations, a doffing truck is moved to a location in front of one of the work positions, and a series of doffing operations to the work station take place based on the reference point memorized with respect to the work station.

The present invention also relates to an apparatus for effecting the above-described method and for doffing packages from a winding machine having a plurality of work stations disposed along the lengthwise direction of a machine frame. The present invention of the plase is characterized in that it comprises:

- a means for memorizing reference points for the respective work stations;
- a doffing truck movable along the winding machine and capable of stopping at locations corresponding to the work positions;
- a doffing mechanism mounted on the doffing truck and capable of performing a doffing operation based on a series of predetermined operating steps; and
- a mechanism for moving the doffing mechanism to a predetermined reference point of the work station.

BRIEF DESCRIPTION OF THE DRAWINGS.

The present invention will now be explained in detail with reference to the accompanying drawings wherein:

FIGS. 16(*b*) and (*c*) are cross sectional view of other embodiments of cradle manipulating arms;

DETAILED DESCRIPTION OF THE INVENTION

The first embodiment of the present invention will now be explained in detail with reference to FIGS. 1 through 10.

Figure 1:
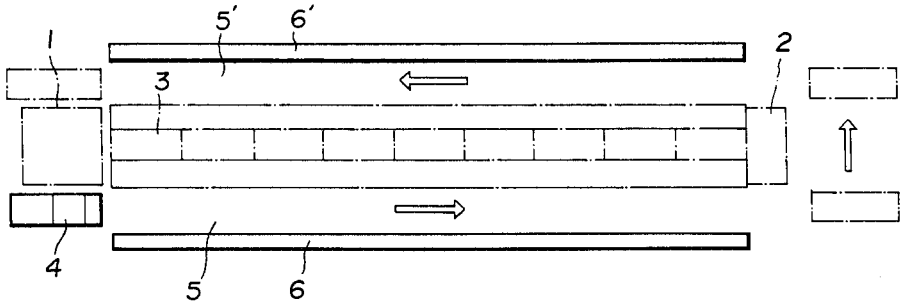
FIG. 1 is a plan view of a draw texturing machine of the present invention.

In FIG. 1, the first embodiment of the present invention is practiced in a draw texturing machine, wherein a plurality of (nine in FIG. 1) blocks 3 are installed between a drive end 1 and a control end 2 of a machine frame. Each block 3 has devices for drawings and simultaneously or sequentially false twisting thermoplastic synthetic yarns, such as feed rollers, delivery rollers, heaters and false twisting devices (not shown) as a conventionally well known draw texturing machine does. Further, 36, for example, work stations are formed on both the sides of the machine frame. Each work station comprises three stages which are vertically superimposed.

On both the sides of the machine frame, there are disposed railways 5 and 5', on which an auto doffer 4 moves, and bobbin supports 6 and 6', which support empty bobbins to be supplied to the winding devices and full bobbins doffed from the winding devices.

Figure 2:
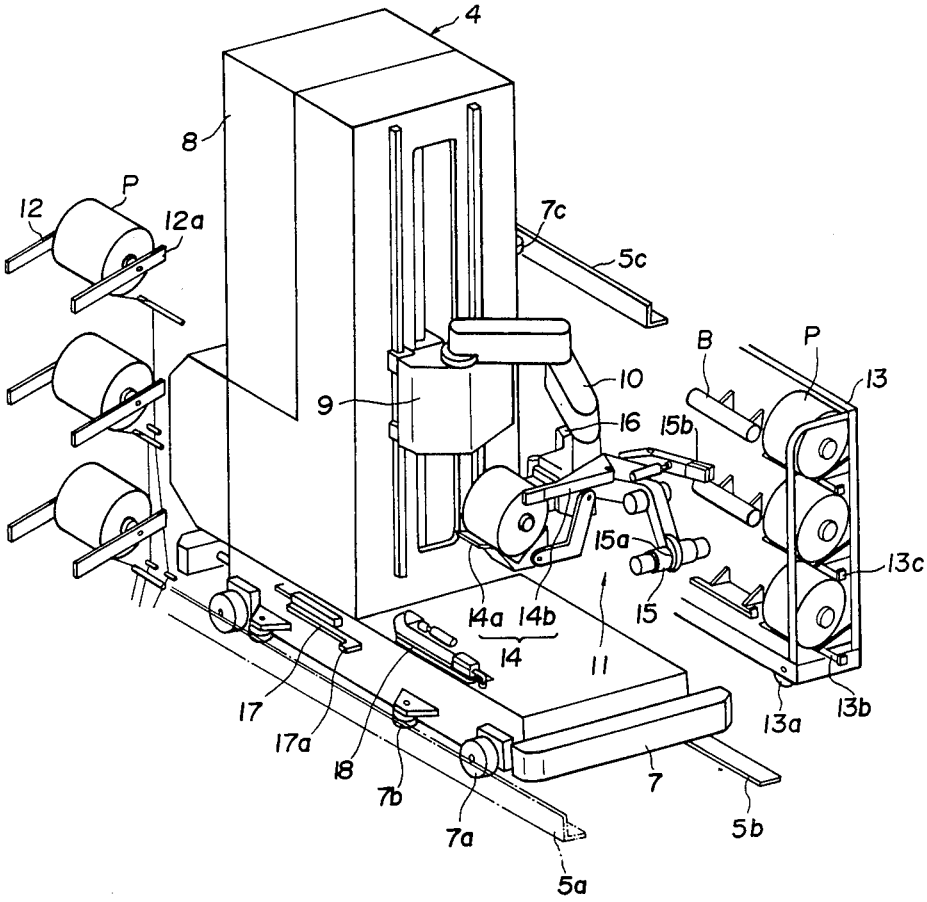
FIG. 2 is a perspective view of a doffing apparatus according to the first embodiment of the present invention.
Figure 3:
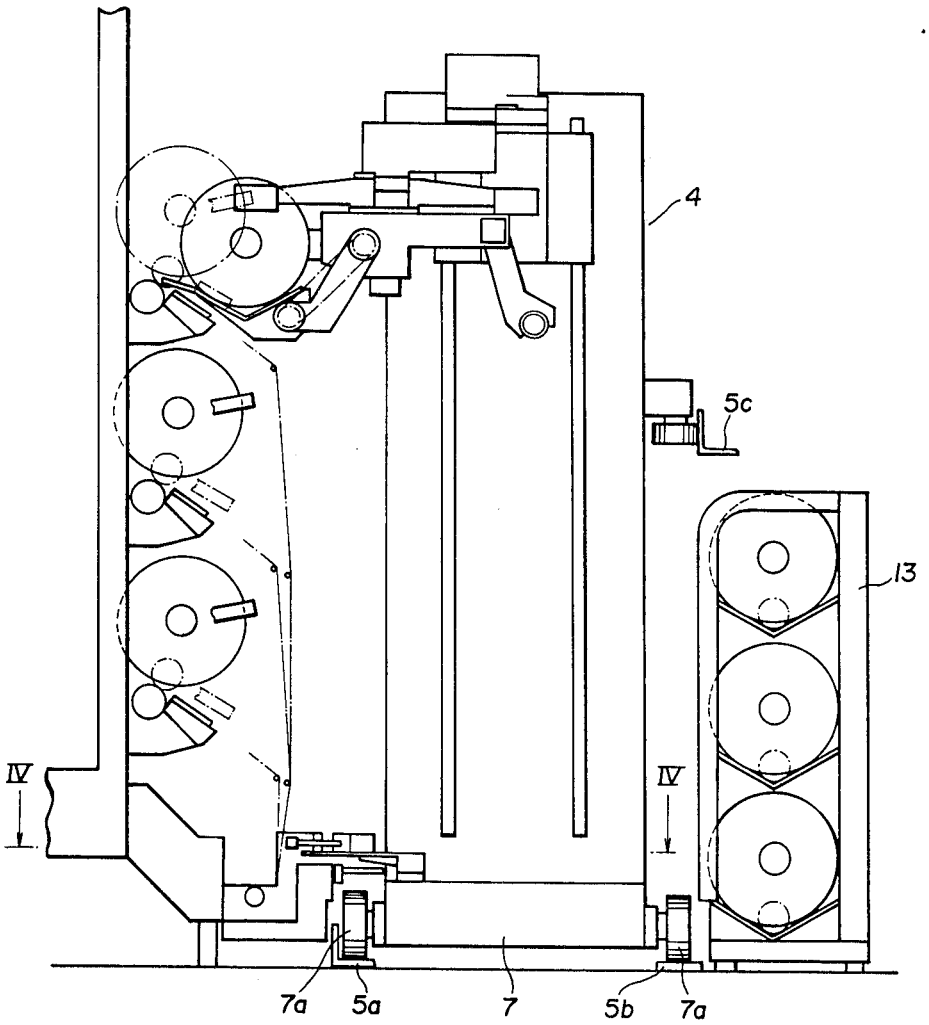
FIG. 3 is an elevation view of FIG. 2.

FIG. 2 is a perspective view of a doffing truck 4 of the first embodiment of the present invention. In FIG. 2, cradles 12 of the winding devices are installed in the draw texturing machine and a bobbin storage truck 13 is used as bobbin supports 6 and 6'.

The cradle 12 has a conventionally well known construction and rotatably holds a bobbin B (not shown) between a pair of arms. The bobbin is pressed to the surface of the driving roller so as to be rotated, and a yarn which is traversed to and fro by means of a traverse device (not shown) is wound onto the bobbin B to form a yarn package P.

The bobbin storage truck 13 is movable on the floor by means of wheels 13*a*. The bobbin storage truck 13 is provided with a plurality of receiving plates 13*b*. The receiving plates 13*b* receive full bobbins P, which have been formed on the bobbins B while the bobbins B are rotatably held by the cradles 12, and support empty bobbins B to be supplied with the cradles 12. The ends 13*c* of the receiving plates 13*b* are upwardly bent so that the empty bobbins B are positioned in the lengthwise direction thereof.

The railway 5 is disposed at the operational floor located between the cradles 12 and the bobbin storage truck 13. The railway 5 comprises a rail 5*a* having an L shaped cross section and a rail 5*b* formed in a strip. The truck body 7 moves along the rails 5*a* and 5*b* by means of wheels 7*a*.

Guide wheels 7*b* laterally supported from the truck body 7 contact the vertical wall of the rail 5*a*, so that the truck body 7 is laterally positioned.

Further, a rail 5*c* is disposed on the machine frame above the bobbin storage truck 13. A guide wheel 7*c* extends from a post 8 mounted on the truck body 7 and contacts the rail 5*c*. As described above, the truck body 7 can move on the railway 5 along the draw texturing machine by means of wheels 7*a*. The rails 5*a*, 5*b* and 5*c* are disposed to enhance the reproducibility of the doffing operations of the present invention which will be performed based on the reference points memorized as will be described later.

The truck body 7 has the post 8 vertically extending therefrom as described above. A head 9 can lift and lower along the post 8. A freely bendable articulated member 10 is an embodiment of an arm member of the present invention and comprises a plurality of (two in FIG. 2) articulations. The articulated member 10 is supported from the head 9 and rotatably supports a doffing member 11.

The doffing member 11 comprises: an arm 14 which doffs full bobbins P formed on the cradles 12 and which transfers them to the receiving plates 13*b* formed on the bobbin storage truck 13; an arm 15 which dons empty bobbins B supported on the receiving plates 13*b* on the bobbin storage truck 13 to the cradles 12 of the winding devices; and a threading arm 16 which transfers the yarn from the full bobbins on the cradles 12 to the empty bobbins B.

The doffing arm 14 comprises: a receiver plate 14*a* which receives the full bobbins P; and a cradle manipulating arm 14*b* which manipulates the handles 12*a* of the cradles 12 to brake the full bobbins P and release them onto the receiver plate 14*a*.

The empty bobbin donning arm 15 comprises: an empty bobbin holding arm 15*a* for holding the empty bobbins B; and a cradle manipulating arm 15*b* which manipulates the handles 12*b* of the cradles 12 to make the cradles 12 hold the empty bobbins B.

The threading arm 16 threads a yarn, one end of which is held by a yarn sucking member 18 which will be explained later, onto an empty bobbin B, which has been mounted on the cradle 12 by means of the empty bobbin donning arm 15, and the threading arm has a yarn threading guide 16*a* (see FIGS. 7 and 9) at the front end thereof.

Figure 4:
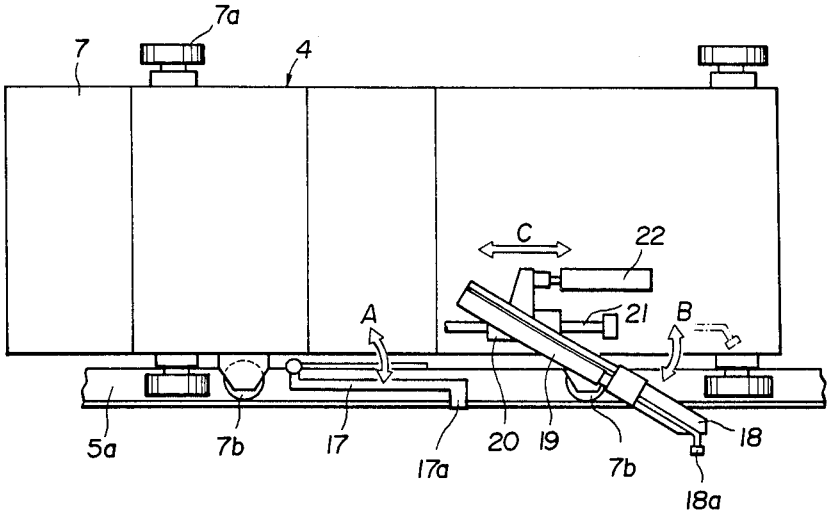
FIG. 4 is a view seen along line IV—IV in FIG. 3.
Figure 5:
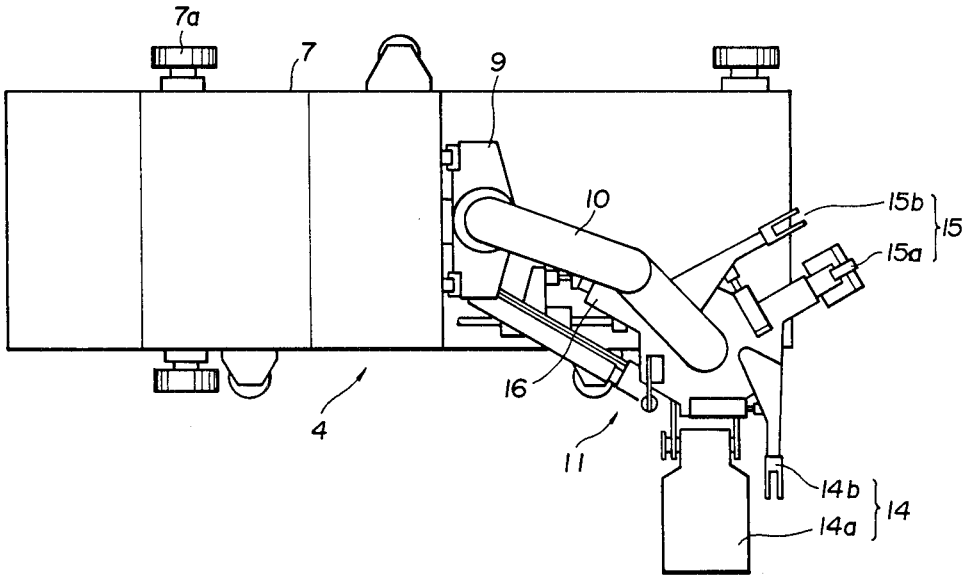
FIG. 5 is a plan view of FIG. 3.
Figure 6:
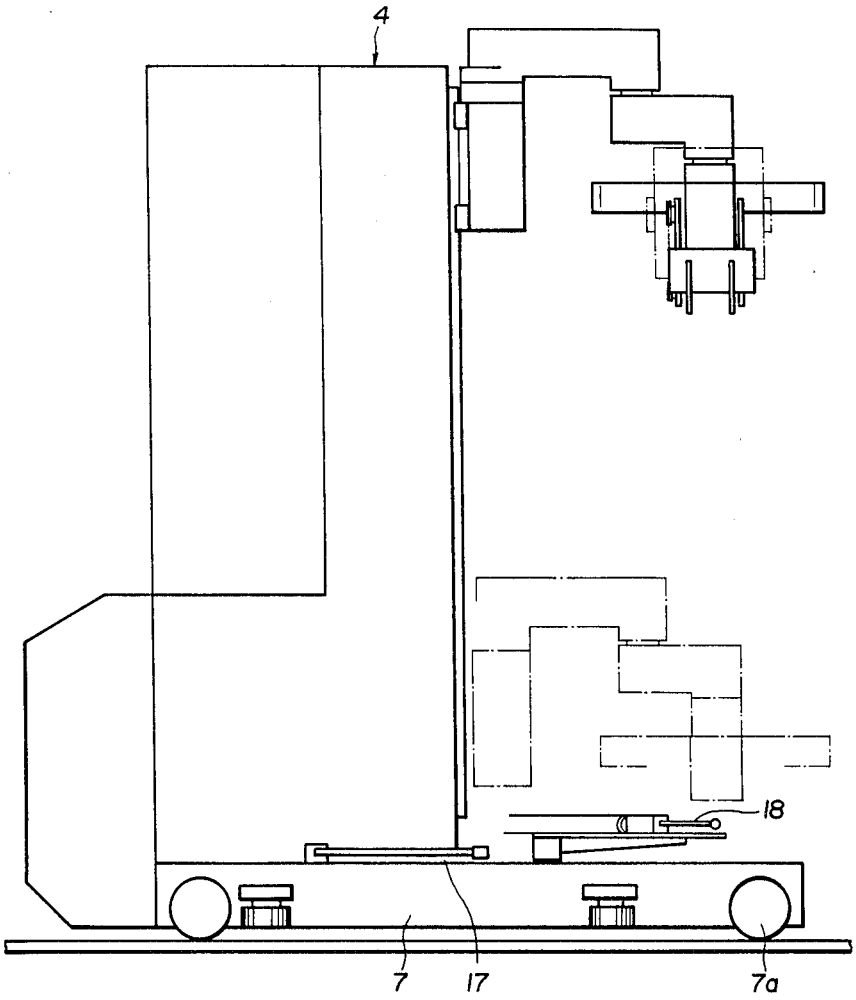
FIG. 6 is a side view of FIG. 3.
Figure 7:
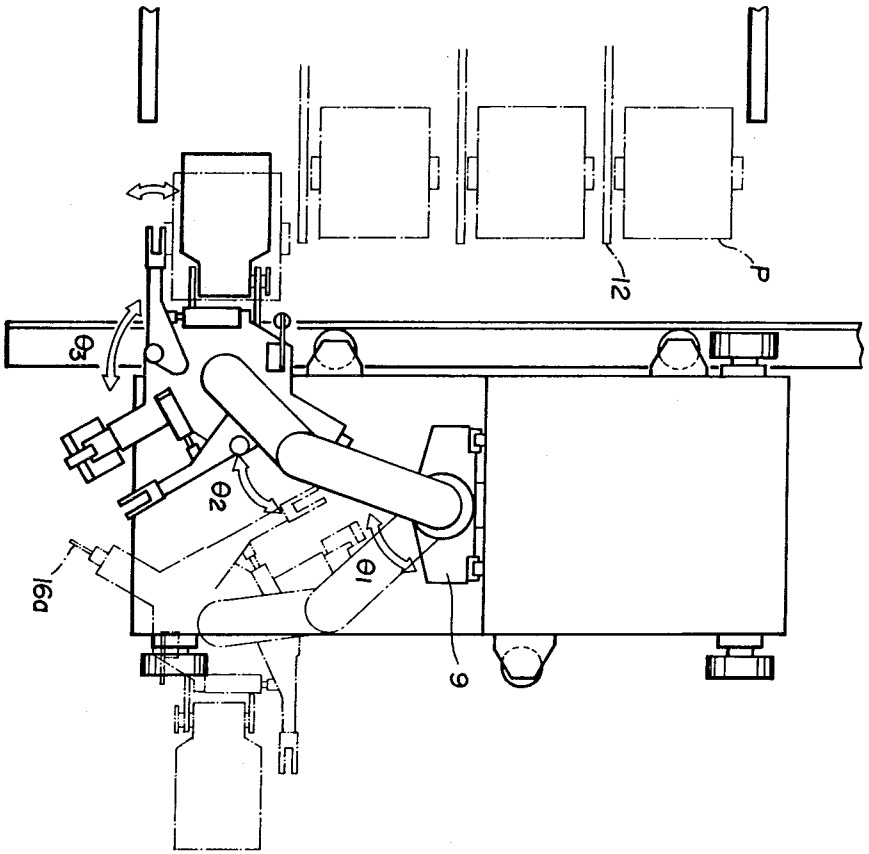
FIG. 7 is a plan view illustrating the operation of a doffing arm.

Further, the truck body 7 has a positioning member 17 mounted thereon. As illustrated in FIG. 4, the positioning member 17 is movable as indicated by an arrow A relative to the machine frame, so that an L shaped end 17*a* engages with and disengages from stop recesses (not shown) formed on the machine frame of the draw texturing machine at a predetermined distance corresponding to the work stations to position the truck body 7 at a predetermined location and make it freely movable.

In addition as illustrated in FIG. 4, the truck body 7 has the yarn sucking member 18 mounted thereon which removes a false twisted yarn, drawn and false twisted by the draw texturing machine, while the doffing operation takes place so as to ensure smooth doffing of full bobbins P and donning of empty bobbins B.

The yarn sucking member 18 has a conventionally known construction which has been used as a suction gun or an aspirator. As illustrated in FIG. 4, the yarn sucking member 18 is fixed on a bracket 19 and has a front end 18*a* bent in a direction perpendicular to the machine frame. The bracket 19 is mounted on a slider 20 in such a manner that it is swingable in a direction indicated by an arrow B by means of the actuation of the fluid pressure cylinder 22. When the reference points are taught or the doffing operation takes place, the bracket 19 is swung as illustrated in FIG. 4. Contrary to this, when the truck body 7 is moving, the bracket is in alignment with the lengthwise direction of the truck body 7 so as not to disturb the movement of the truck body 7.

Further, a servomotor (not shown) controls the movement of the slider 20 in a direction (in a lengthwise direction of the draw texturing machine) indicated by an arrow C along a guide 21 fixed on the truck body 7. The slider 20 is connected to a position detecting device (not shown), and locational signals emitted from the position detecting device can be memorized in a memory (not shown) mounted on the truck body 7 and consisting of random access memory (RAM).

The doffing arm 14, the empty bobbin donning arm 15 and the yarn threading arm 16 are designed in such a manner that they perform predetermined operations for doffing full bobbin P, for donning empty bobbins B and for threading yarn based on the signal regarding the above-described reference points by means of a control means (not shown) mounted on the truck body 7 and comprising a processor, random access memory (RAM), read only memory (ROM), or the like. Before starting the doffing operation, the operations of the articulated member 10 and the yarn sucking member 18 are taught to the memory. More specifically, the modes of the articulated member 10 and the yarn sucking member 18 are set to a teaching mode, and the auto doffer 4 is moved on the railway 5 along the machine frame and is stopped by means of the positioning member 17 at the first work station. Then, the slider 20 is moved along the guide 21 by means of a manual operation or a joystick so that the yarn sucking member 18 faces a yarn passage extending from the delivery roller to the winding device of the draw texturing machine. Under this condition, the memorizing switch is manually turned on to memorize the reference point with respect to the work station in the memory. Similarly, the articulated member 10 is operated by means of a manual operation or a joystick so as to memorize the reference points in the memory, based on which points a series of operations, for holding an empty bobbin, for swinging cradles and for threading a yarn to guide rollers and a bobbin are performed. Thereafter, the auto doffer 4 is moved to the second work station, and subsequently the remaining work stations, and similar operations are repeated to teach the reference points with respect to the respective work stations.

In short, the doffing apparatus of the present invention includes (1) a means for memorizing a basic operation of the doffing apparatus and (2) a means for memorizing an actual operation after modifying the basic operation based on the memorized reference points.

Accordingly, the particular positions of the winding devices of the winding machine are directly taught to the doffing apparatus as reference points, when the passages in the bobbin handling step and the bobbin handling step have been previously memorized, and a previously memorized basic passages are modified by a passage modifying program based on the taught reference points.

The doffing operation is performed as follows. While the yarn sucking member 18 is set to be parallel to the truck body 7, the auto doffer 4 moves on the railway 5 and is positioned at a predetermined location in front of the work station by means of the positioning member 17. Then, the yarn sucking member 18 is swung toward the machine frame, and the yarn sucking member 18 moves to a predetermined location based on the signal regarding the reference point which has previously been memorized so that it faces the yarn passage and sucks the yarn. A cutter (not shown) having a conventionally known construction is disposed at a position near the yarn sucking member 18 and is actuated by means of an electromagnet. Automatically detecting the sucking of the yarn, the cutter is operated to cut the yarn extending to the winding device, and the yarn is sucked by the sucking member 18. From this condition, the operations are performed in accordance with a predetermined operational sequence so as to doff a full bobbins P from the cradle 12, donn an empty bobbin B to the cradle 12 and to thread a yarn to the empty bobbin B.

Figure 8:
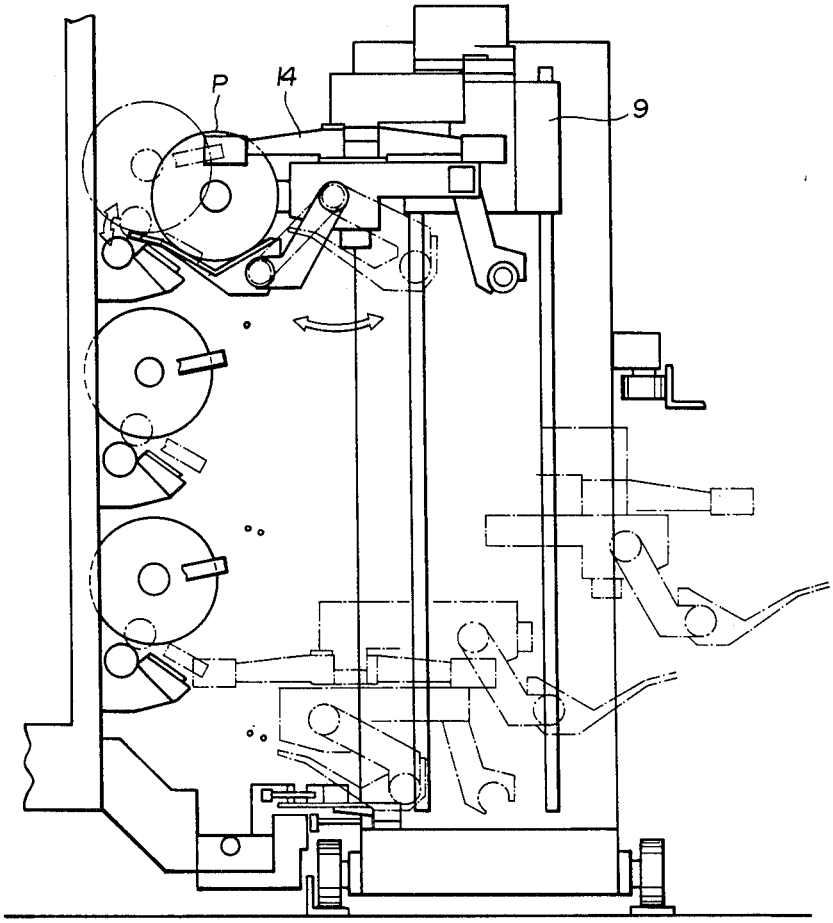
FIG. 8 is an elevation view of FIG. 7.
Figure 9:
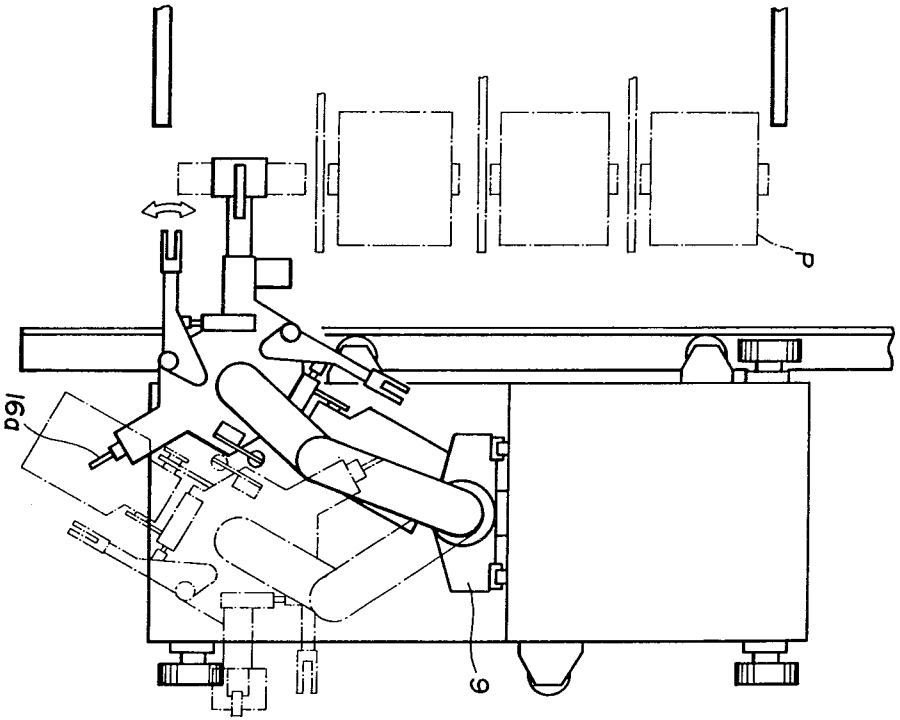
FIG. 9 is a plan view illustrating the operation of an empty bobbin donning arm.
Figure 10:
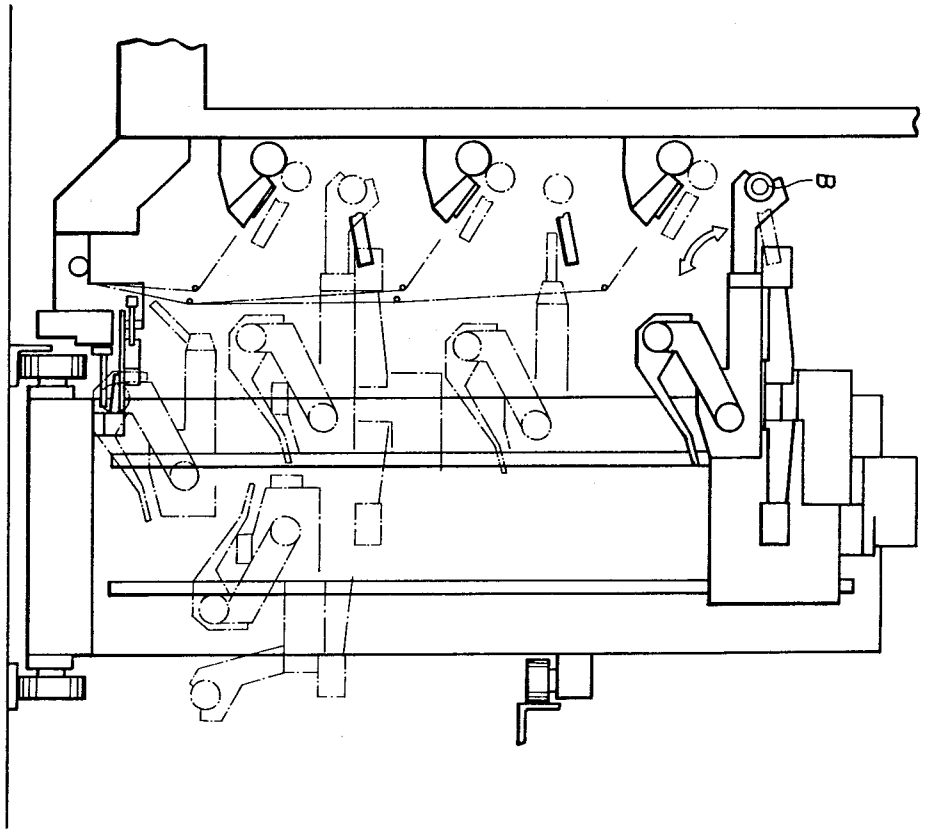
FIG. 10 is an elevation view of FIG. 9.

More specifically, the empty bobbin donning arm holds an empty bobbin B, and the head 9 is lifted to a predetermined height, for example, that corresponding to the uppermost winding device, and the doffing arm 14 doffs a full bobbin P (see FIG. 8). The empty bobbin B is connected to the winding device, from which the full bobbin has been doffed. While the doffing arm 14, having the full bobbin P, and the doffing member 11 are rotated at the front end of the articulated member 10, the articulated member 10 is bent so that the doffing arm 14 faces the receiving plate 13*b* of the bobbin storage truck 13, and then, the full bobbin P is put on the receiving plate 13*b*. The yarn threading guide 16*a* of the yarn threading arm catches the yarn at a location near the yarn sucking member 18 and threads it onto the empty bobbin B. Similar operations are repeated with respect to the intermediate winding device and the lowermost winding device to doff the full bobbins P and put them on the receiving plates 13*b* of the bobbin storage truck 13.

After the above-described operations are completed the auto doffer 4 is moved to the next work station, and similar operations are repeated at all the work stations.

In the explanation described above with respect to the first embodiment of the present invention, a sequence of the doffing operation, the empty bobbin doping operation and the threading operation take place at each of the three stages of winding devices in sequence, and the sequential operations are repeated to the three stages located at one work station.

If such doffing, donning and threading operations are performed, there may occur a trouble that a yarn which extends to a full bobbin to be doffed or which has already been threaded disturbs a smooth doffing, donning or threading operation regarding another full or empty bobbin.

If it is a case, it is possible to perform the doffing operation of all the stages of a work station, the empty bobbin donning operation of the stages and the threading operation of the stages in sequence as will be described with reference to the second embodiment.

Further in the foregoing explanation, the auto doffer 4 is moved in front of the winding devices and the moving passages of the articulated member 10 and the yarn sucking member 18 are memorized in a memory by moving them by means of manual operation or joystick prior to the doffing operation, it is preferable to move the doffing apparatus as a so called measuring robot to automatically memorize the moving passages of the yarn sucking member 18 and the articulated member 10 by operating the threading arm 16 at the work stations, while a jig for measuring the reference points and a touch senser is attached to the front end of the threading arm 16.

In addition, when the present invention is practiced, it is possible to set one or a plurality of reference points for each work station. When a plurality of reference points are set for one work station, it is preferable to amend the operational passage during the doffing operation based on the signals corresponding to the reference points. In this case, it is preferable to move the members between the reference points by way of so called point to point method.

When the teaching is manually done, theoretical moving passages of the articulated member 10 and the yarn sucking member 18 are memorized as a basic program based on a design drawing and a layout drawing of the machine, such as DTY machine, it is preferable that the variation between the actual movement and the required movement is amended by means of the manual operation or a joystick while the auto doffer is operated based on the basic program.

The second embodiment of the present invention will now be explained in detail.

The second embodiment of the present invention is also practiced in a draw texturing machine which is almost the same as that explained with reference FIG. 1 regarding the first embodiment.

Figure 11:
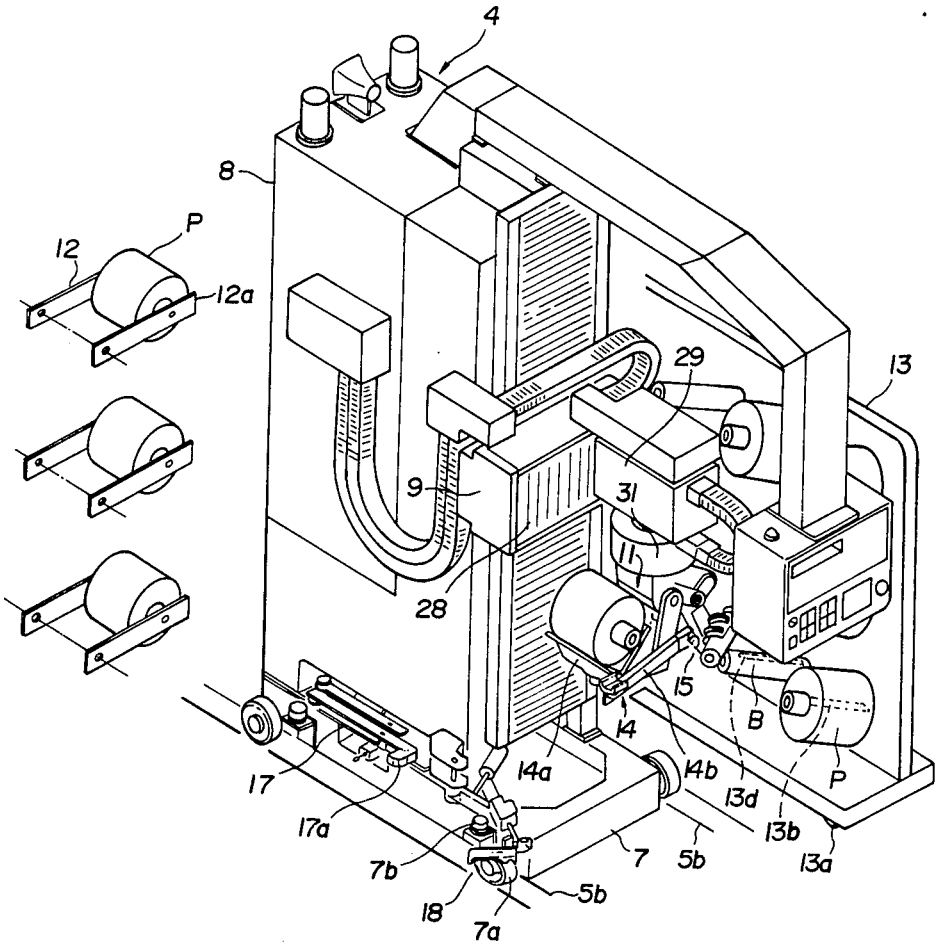
FIG. 11 is a perspective view of a doffing apparatus according to the second embodiment of the present invention.

FIG. 11 is a perspective view of a doffing truck 4 of the second embodiment of the present invention. FIG. 11 illustrates cradles 12 of the winding devices installed in the draw texturing machine and a bobbin storage truck 13 used as bobbin supports 6 and 6'.

The bobbin storage truck 13 is movable on the floor by means of wheels 13*a*. The bobbin storage truck 13 is provides with a plurality of pegs 13*d*. The pegs 13*d* are used to hold full bobbins P, which have been formed on the bobbins B while the bobbins B are rotatably held by the cradles 12, and support empty bobbins B to be supplied to the cradles 12.

The railway 5 is disposed at the operational floor located between the cradles 12 of the bobbin storage truck 13. The railway 5 of the present embodiment comprises two strip rails 5*b*. The truck body 7 moves along the rails 5*b* by means of wheels 7*a*.

Guide wheels 7*b* is laterally supported from the truck body 7 and contact the vertical wall (not shown) disposed at the side of the machine frame so that the truck body 7 is laterally positioned.

The truck body 7 has the post 8 vertically extending therefrom. A Y-axis beam 9 can lift and lower along the post 8 by means of the operation of a Z-axis drive motor (not shown). The Y-axis beam has an X-axis beam 29 horizontally extending therefrom. The X-axis beam 29 is horizontally movable along the Y-axis beam 9 by means of the operation of a Y-axis motor drive (not shown). A wrist member is disposed at the bottom surface of the X-axis beam 29. The wrist member 31 is horizontally movable along the X-axis beam 29 toward and away from the Y-axis beam 9 by operation of an X-axis drive motor (not shown). Further, the wrist member 31 is rotated by the operation of a $\theta_1$ axis drive motor (not shown).

The wrist member 31 comprises: an arm 14 which doffs full bobbins P formed on the cradles 12 and which transfer them to the pegs 13*d* on the bobbin storage truck 13; an arm 15 which donns empty bobbins B supported on the pegs 13*d* on the bobbins torage truck 13 to the cradles 13 of the winding devices; and a threading arm 16 which transfers the yarn from the full bobbins on the cradles 12 to the empty bobbins B. The wrist member 31 and the arms 14, 15 and 16 comprise a doffing mechanism.

Figure 12:
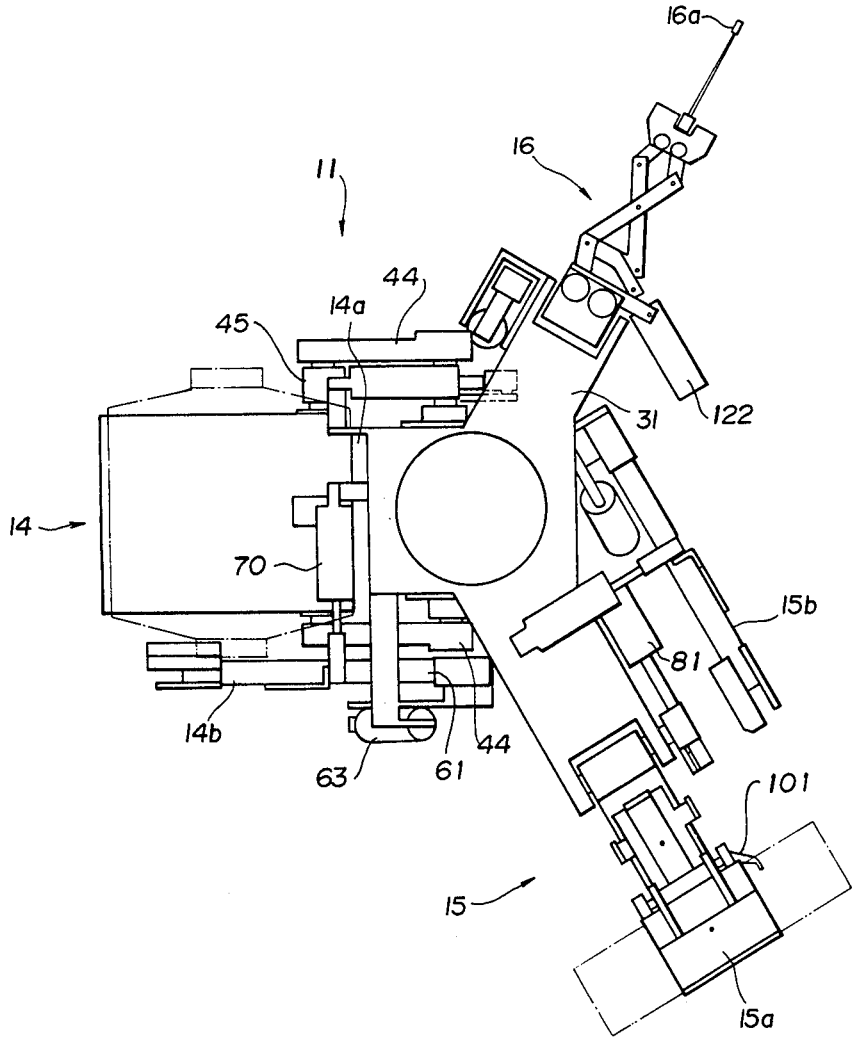
FIG. 12 is a plan view of a part of FIG. 11.

As illustrated in FIG. 12, the doffing arm 14 comprises: a receiver plate 14*a* which brakes the full bobbins P and receives them; and a cradle manipulating arm 14*b* which manipulates the handles 12*a* of the cradles 12 to release the full bobbins P onto the receiver plate 14*a*.

The empty bobbin donning arm 15 comprises: an empty bobbin holding arm 15*a* for holding the empty bobbins B; and a cradle manipulating arm 15*b* which manipulates the handles 12*b* of the cradles 12 to make the cradles 12 hold the empty bobbins B.

The threading arm 16 threads a yarn, one end of which is held by a yarn sucking member 18 which will be explained later, onto an empty bobbin B, which has been mounted on the cradle 12 by means of the empty bobbin donning arm 15, and the threading arm has a yarn threading guide 16*a* at the front end thereof.

Referring to FIG. 11 again, the truck body 7 further has a positioning member 17 mounted thereon. Similar to the above-described first embodiment, the positioning member 17 is movable relative to the machine frame, so that an L shaped end 17*a* engages with and disengages from stop recesses (not shown) formed on the machine frame of the draw texturing machine at a predetermined distance corresponding to the work station to position the truck body 7 at a predetermined location and make it freely movable.

In addition, the truck body 7 has the yarn sucking member 18 mounted thereon which removes a false twisted yarn, which is drawn and false twisted by the draw texturing machine, while the doffing operation takes place so as to ensure smooth doffing of full bobbins P and donning of empty bobbins B.

Figure 13:
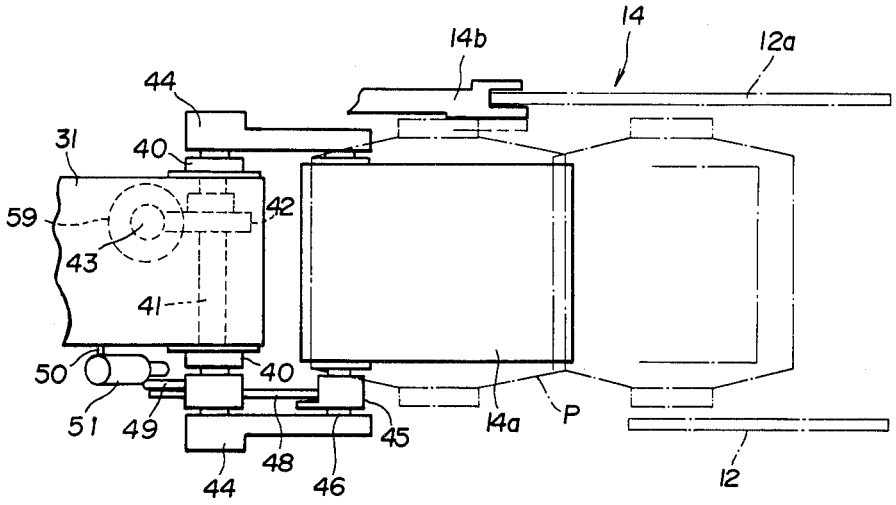
FIG. 13 is a plan view of a part of FIG. 12.
Figure 14:
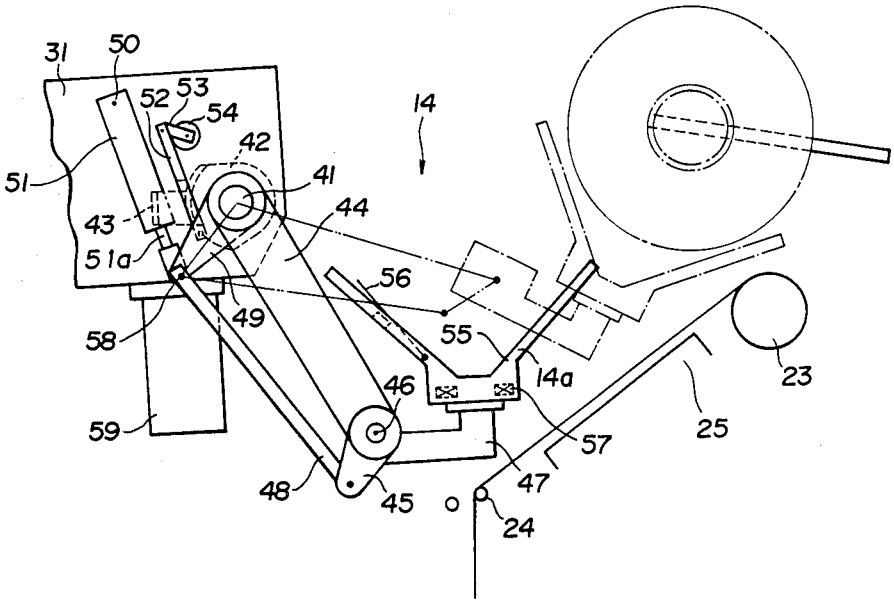
FIG. 14 is a side view of FIG. 13.

Referring to FIGS. 13 and 14, the construction of the doffing arm 14 will now be explained in detail. At a front end of the wrist member 31, a shaft 41 is rotatably supported by means of a pair of bearings 40. A worm wheel 42 is fixed to the shaft 41 and engages with a worm 43. The worm 43 is fixed on the output shaft of a servomotor 59; i.e., a motor for driving $\theta_2$-axis.

The ends of the shaft 41 have links 44 secured thereto. The front ends of the links 44 are connected to each other by means of a shaft 46. A link 45 is secured to the shaft 46, and another link 49 is turnably connected to the shaft 41. The ends of the links 45 and 49 are connected to each other by means of a rod 48. As is apparent from FIG. 14, the lengths of the links 45 and 49 are not equal, and accordingly the links 44, 45 and 49 and rod 48 form a quadric crank chain which is not a parallel crank mechanism.

A pin 58 connects the link 49 and rod 48, and it is connected to a piston rod 51*a* of the fluid pressure cylinder 51.

The link 49 is connected to a detector 54 for detecting a rotational angle of the link 49 through levers 52 and 54. A resolver, for example, may be used as the detector 54.

A holder 47 is fixedly connected to the link 45. The holder 47 rotatably supports a full bobbin receiving plate 14*a* by means of a cross roller bearing 57. The plate 14*a* comprises a pair of arms 55 forming a predetermined angle therebetween. A limit switch 56 detects whether or not a full bobbin is received on the plate 14*a*.

A fluid pressure cylinder (not shown) is disposed on the holder 47 to turn the plate 14*a* 90° about a vertical line so that the plate 14*a* can be turned from a position illustrated in FIG. 14 to a position perpendicular thereto about a vertical line, when the full bobbin is inserted onto a peg of the bobbin truck.

As a result of the above-described construction, when the truck body 7 moves, the doffing arm 14 is folded to a position near the wrist member 31 by extending the piston rod 51*a*. When the servomotor 59 is actuated, the shaft 41 can be rotated via worm 43 and worm wheel 42, and the receiving plate 14*a* is moved upwardly or downwardly. When the full bobbin P is doffed, the plate 14*a* lifts to a position near the outer surface of the full bobbin. The plate 14*a* becomes in contact with the outer surface of the full package by further extending the piston rod 51*a*. Thus the rotation of the full package due to inertia is braked by means of the receiving plate 14*a*. At the same time, the rotational angle of the shaft 41 due to the actuation of the surface pressure cylinder 51 is detected by the detector 54 to know the moving distance of the receiving plate 14. The detected value varies in accordance with the thickness of the packages P, and accordingly, is used to modify the moving amount in a Z-axis direction of the Y-axis beam 9 when the package P is inserted onto the peg 13*d* of the bobbin truck 13.

In addition, to the quadric crank chain, the plate 14*a* can move in a predetermined passage.

The construction of the cradle manipulating arm 14*b* will now be explained in detail with reference to FIGS. 14 and 15. The cradle manipulating arm 14*b* is used to manipulate the handles 12*a* of the cradles 12 to release the full bobbins P onto the receiver plate 14*a*.

Figure 15:
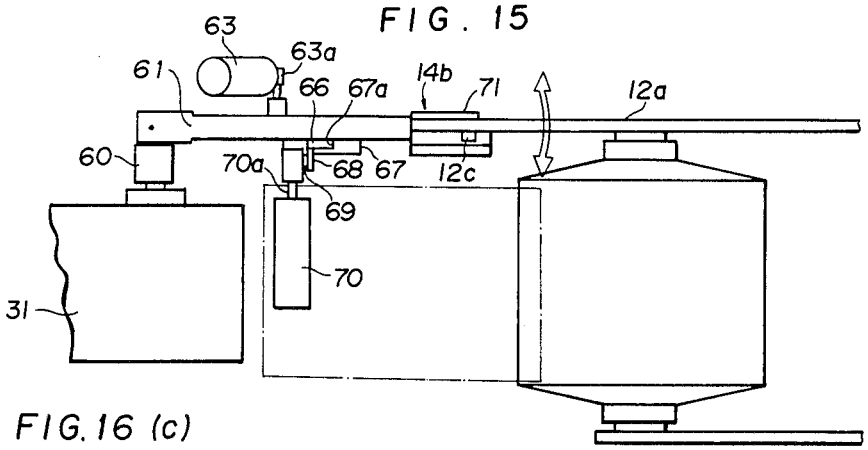
FIG. 15 is a plan view of a part of FIG. 12.

An L-shaped bracket 60 extends from the wrist member 31 as illustrated in FIG. 15. Ends of an arm 61 and a rod 62 which have a same length are pivoted to the bracket 60 by means of self aligning roller bearings, and the other ends of the arm 61 and the rod 62 are also pivoted to the cradle gripper 71 by means of self aligning roller bearings. As a result a parallel crank mechanism is formed by the bracket 60, the arm 61, rod 62 and the cradle gripper 71.

Figure 17:
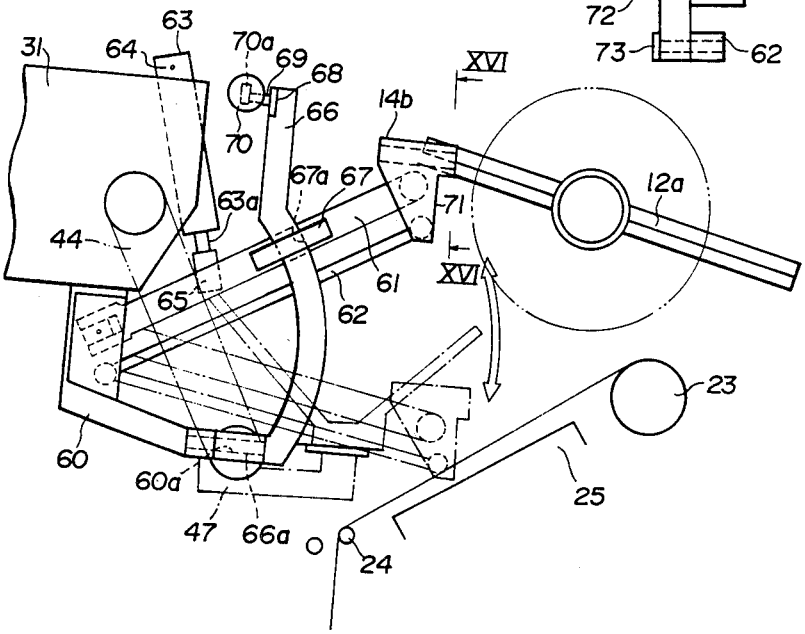
FIG. 17 is a side view of FIG. 15.
Figure 18:
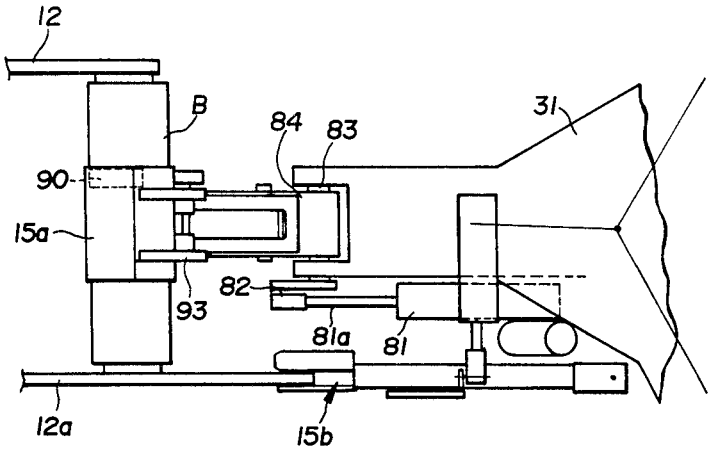
FIG. 18 is a plan view of a part of FIG. 12.

A fluid pressure cylinder 63 is pivoted on the wrist member 31 by a pin 64. The pin 64 is supported on a bracket (not shown), which is disposed on the wrist member 31. An end of a piston rod 63*a* of the fluid pressure cylinder 63 is pivoted to the arm 61 by a pin 65. As a result, the cradle manipulating arm 14*b* can be swung vertically by means of the fluid pressure cylinder 63 as indicated by an arrow in FIG. 17.

A hole 60*a* is formed at the front end of the L-shaped bracket 60. A pin 66*a* is formed at the lower end of a bow shaped guide bar 66 and is engaged with the hole 60*a*. A projection 68 is formed at the top of the guide bar 66 and is connected to a piston rod 70*a* of a fluid pressure cylinder 70 by means of a pin. A guide 67 is attached to the arm 61 and has a rectangular recess 67*a* formed therein. The bow shaped guide bar 66 is inserted into the recess 67*a*. As a result, the cradle manipulating arm 14*b* can be swung horizontally by moving the guide bar 66 by means of the fluid pressure cylinder 70 as indicated by an arrow in FIG. 15.

Figure 16:
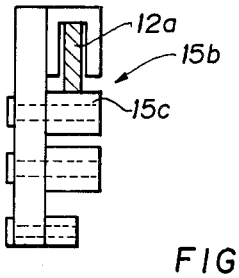
FIG. 16(*a*) is a cross sectional view sectioned along line XVI—XVI in FIG. 17.
Figure 16:
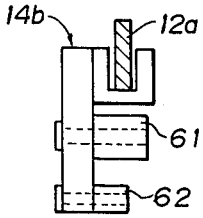
Figure 16:
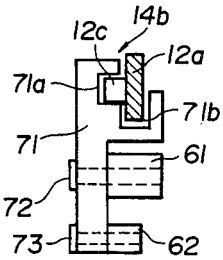

As illustrated in FIG. 16(*a*), a groove 71*a* and a groove 71*b* are formed on the side wall of the cradle gripper 71 and the lower wall of the projection, respectively, in a lengthwise direction thereof. The cradle gripper 71 lifts the handle 12*a* of the cradle 12 by engaging the groove 71*a* with a pin 12*c* projecting from the handle 12*a* and by supporting the lower side of the handle 12*a* on the groove 71*b*. Since the manipulating arm 14*b* of the doffing arm 14 only lifts the handle 12*a*, the upper shoulder of the groove 71*a* may be omitted.

The empty bobbin donning arm 15 will now be explained in detail with reference to FIGS. 18 through 21. As described above, the empty bobbin donning arm 15 comprises: an empty bobbin holding arm 15*a* for holding the empty bobbins B; and a cradle manipulating arm 15*b* which manipulates the handles 12*b* of the cradles 12 to make the cradles 12 hold the empy bobbins B. The construction of the cradle manipulating arm 15*b* of this embodiment is almost the same as that of the cradle manipulating arm 14*b* of the doffing arm 14 which has been described above with reference to FIG. 16(*a*).

Another embodiment of the cradle manipulating arm of the doffing arm 14 is illustrated in FIG. 16(*b*), wherein the cradle hand 12*a* is lifted up by the cradle manipulating arm 14*b* which is formed in a U-shaped cross section. FIG. 16(*c*) illustrates an embodiment of the cradle manipulating arm 15*b* of a donning arm 15. This cradle manipulating arm 15*b* has a reverse U-shaped cross section and includes a cushion member 15*c* made of rubber. The cradle hand 12*a* is sandwiched by the U-shaped member and the cushion member 15*c* and is pressed down by the U-shaped member.

Figure 19:
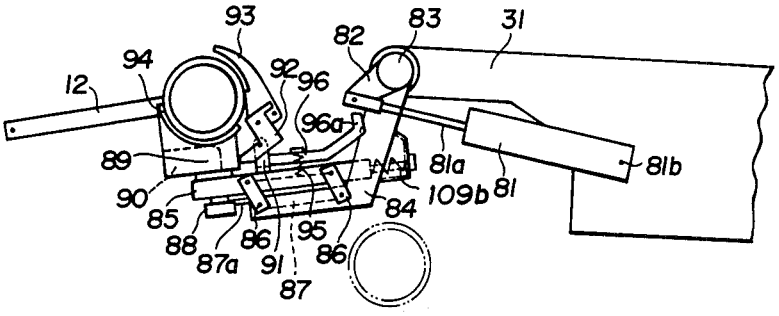
FIG. 19 is a side view of FIG. 18.

The empty bobbin holding arm 15*a* will now be explained in detail. In FIG. 19, the right end 81*b* of a fluid pressure cylinder 81 is rotatably supported on the wrist member by a pin 81*b*. A piston rod 81*a* of the fluid pressure cylinder 81 is connected to a lever 82. The lever 82 is fixed to a shaft 83 which is swingably supported on the wrist member 31. An arm 84 is also fixed to the shaft 83, and therefore, the lever 82 and the arm 84 are moved in one body by means of the fluid pressure cylinder 81.

Figure 20:
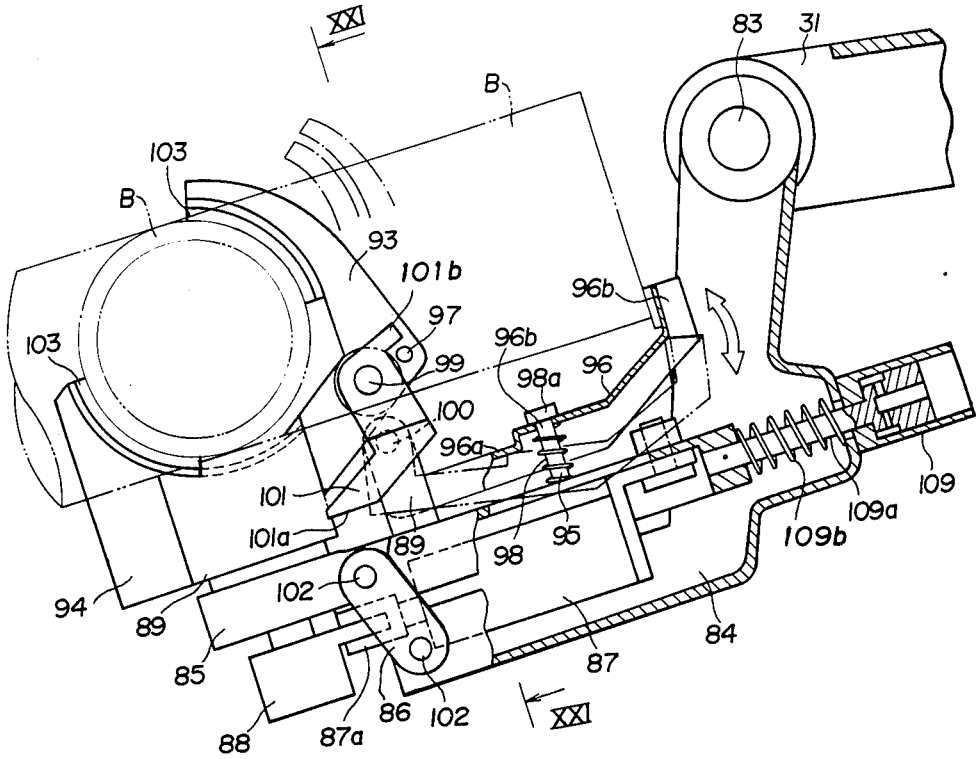
FIG. 20 is an enlarged and partially cross sectioned view of FIG. 19.

The arm 84 mounts an empty bobbin holding chuck by means of an adaptable mechanism. In FIG. 20, the adaptable mechanism of this embodiment comprises a pair of levers 86 pivoted to the arm 84 by pins 102 and a base plate 85 pivoted to the levers 86 by pins 102 to form a parallel mechanism. Accordingly, the base plate 85 can move relative to the arm 84, while they are parallel to each other. Furthermore, a compression spring 109*b* is disposed between the arm 84 and the right end of the base plate 85 to urge the latter to the left. In addition, as illustrated in FIG. 20 the right end of the base plate 85 is connected to a piston rod 109*a* of a fluid pressure cylinder 109 disposed at the right wall of the arm 84 to urge the base plate 85 to the right against the spring force of the spring 109*b* when the space for moving the chuck is restricted, such as when an empty bobbin B is withdrawn from a peg 13*d* of the bobbin truck 13.

A bearing member 89 is turnably supported on the base plate. The lower end 88 of the bearing member 89 is pivotally connected to a piston rod 87*a* of a fluid pressure cylinder 87 which is suspended from the base plate 85. Accordingly, the bearing member 89 can be turned 90° by means of the fluid pressure cylinder 87, and it locates at a position illustrated in FIG. 20 and a position perpendicular thereto about a substantially vertical line.

Figure 21:
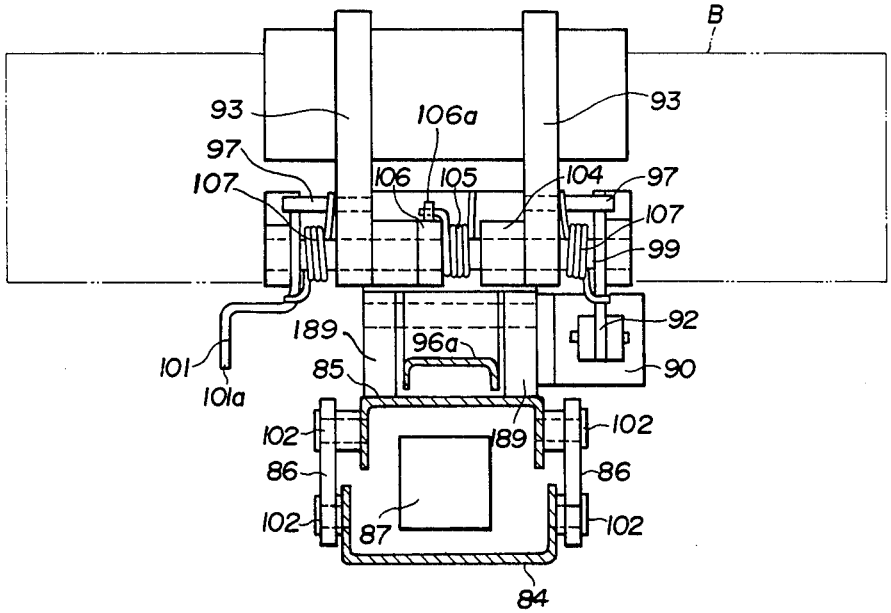
FIG. 21 is a cross sectional plan view cross sectioned along line XXI—XXI in FIG. 20.

The empty bobbin holding chuck comprises a stationary finger 94 secured to the bearing member 89 and movable fingers 93 as illustrated in FIG. 19. The movable fingers 93 are spaced from each other as illustrated in FIG. 21. The movable fingers 93 have pins 97 projecting therefrom and are swingably supported on the stationary finger 94 by means of a shaft 99 as illustrated in FIG. 20. More specifically, the shaft 99 is rotatably supported on the stationary finger 94. A lever 92, an urging pawl 101 and a collar 106 are secured to the shaft 99.

The lower end of the lever 92 is connected to a fluid pressure cylinder 90 which is supported on the bearing member 89. The upper end of the lever 92 has a projection (not shown) projecting therefrom and capable of engagement with the pin 97. The lower end of the urging pawl 101 is capable of engagement with a urging surface 96*a* of the stopper member 96 as will be described later in detail. The upper end of the urging pawl 101 has a projection 101*b* projecting therefrom and capable of engagement with the pin 97.

A helical torsion spring 105 is disposed between a pin 106*a* projecting from the collar 106 and the bearing member 89, and helical torsion springs 107 are disposed between the pin 97 and the lever 92 and between the pin 97 and the urging pawl 101. The spring 105 urges the movable fingers 93 outwardly, contrary to this, the spring 107 urges the movable fingers 93 inwardly to hold the empty bobbin B.

Reference numeral 103 indicates a rubber plate attached to the insides of the stationary and movable fingers 94 and 93.

In FIG. 21, when the piston rod of the fluid pressure cylinder 90 is retracted, the upper projections of the lever 92 and the pawl 101 engage with the pins 97, and the movable fingers 93 are moved outwardly by means of the spring 105. Contrary to this, when the piston rod of the fluid pressure cylinder 90 is extended, the springs 107 are twisted. Then, the movable fingers 93 are moved inwardly due to the force of the spring 107 and they hold the empty bobbin B. The piston rod of the fluid pressure cylinder 90 continues its forward movement and the springs 107 are further twisted.

Referring to FIG. 20, a stopper member 96 has a stop surface 96*b* at the right end thereof, and the distance between the stop surface 96*b* and the rotational center of the bearing member 89 is equal to a half of the length of the bobbin B.

The stopper member 96 is swingably supported by a pin 100, which is secured to a pair of brackets 189 projecting from the base plate 85. A pin 98 with a head 98*a* passes through a hole 96*c* formed on the surface of the stopper member 96 and is secured to the base plate 85. A compression spring 95 is disposed between the base plate 85 and the stopper member 96 to urge the latter upwardly. Accordingly, the stopper plate 96 is normally located at a position illustrated by a solid line in FIG. 20, and positions an empty bobbin B illustrated by a dot dash line in FIG. 20. The stopper plate 96 is moved downwardly as illustrated by a dot dash line when the surface thereof is pressed downwardly.

The lower surface 101*a* of the urging pawl 101 locates on the urging surface 96*a* of the stopper member 96 when the bearing member 89 is turned 90° about a substantially vertical line from the condition illustrated in FIGS. 18 through 21. Empty bobbin B supported on the peg 13*d* is held as follows. From the condition described above, the stopper surface 96*b* is abutted with the end surface of the empty bobbin B so as to position the empty bobbin B. Then, the Y-axis beam 9 is lifted to slightly raise the arm 84. After the empty bobbin B is lifted from the peg 13*d*, the piston rod of the fluid pressure cylinder 90 is extended to lower the pawls 93 and 101 and to grasp the empty bobbin B. The piston rod of the fluid pressure cylinder 90 is further extended even after the empty bobbin is grasped. Accordingly, the urging pawl 101 is further lowered until it becomes in contact with the stopper surface 96*a*, and thus the stopper member 96 is swung downwardly. As a result, the engagement between the stopper surface 96*b* and the end surface of the empty bobbin B is released, and the bearing member 89 is ready to be rotated.

The construction of the threading arm of the present invention will now be explained in detail with reference to FIGS. 22 through 25.

Figure 22:
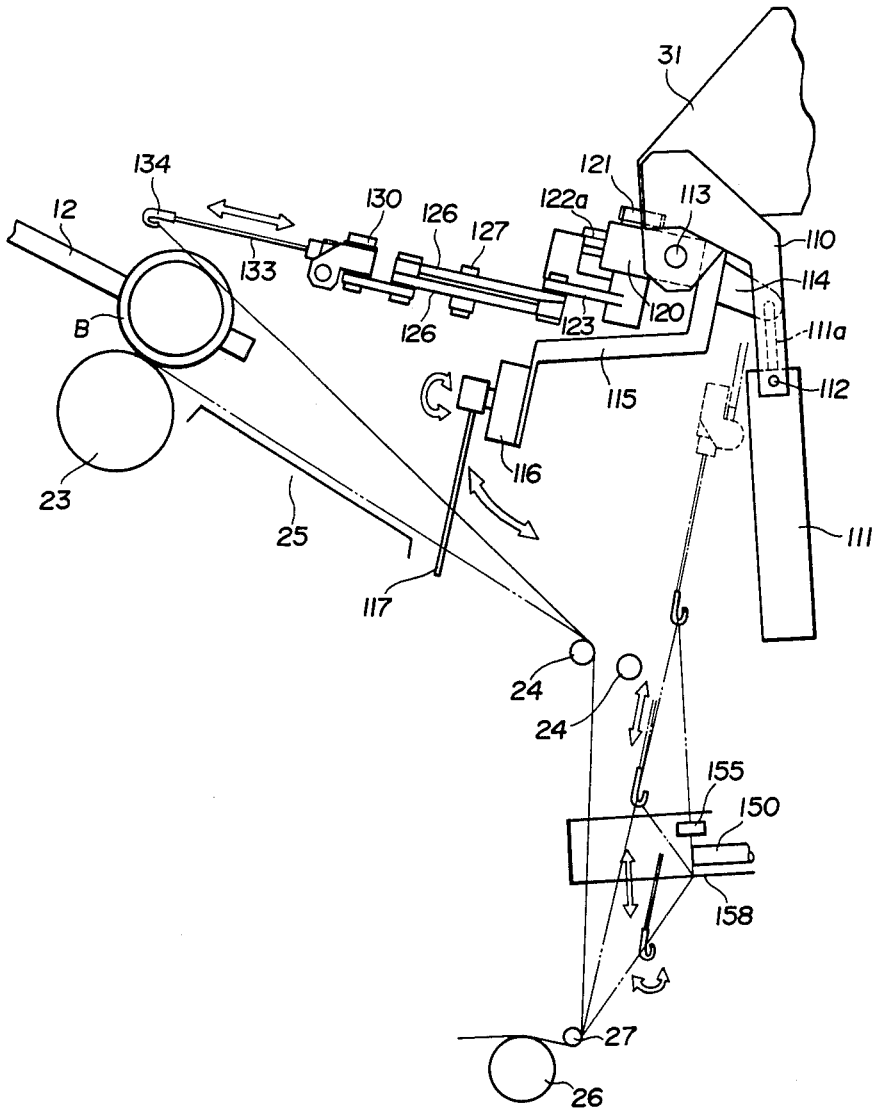
FIG. 22 is an elevation view of a threading arm mounted on the doffing truck illustrated in FIG. 11.

Referring to FIG. 22, a bracket 110 hangs down from the wrist member 31 and pivotally supports a pneumatic cylinder 111. A shaft 113 is rotatably supported on the wrist member 31. An arm 114, a bracket 115, and a holder 120 are secured to the shaft 113. The right end of the arm 114 is rotatably connected to a piston rod 111*a* of the fluid pressure cylinder 111, and accordingly, the arm 114 and the bracket 115 are swung by means of the fluid pressure cylinder 111.

The bracket 115 is formed in a Z-shape, and a rotary cylinder 116 is disposed at the lower end of the bracket 115. A rotary shaft of the rotary cylinder 116 has a bunch guide 117 fixed thereon. Accordingly, the bunch guide can be rotated by means of the rotary cylinder 116.

Figure 23:
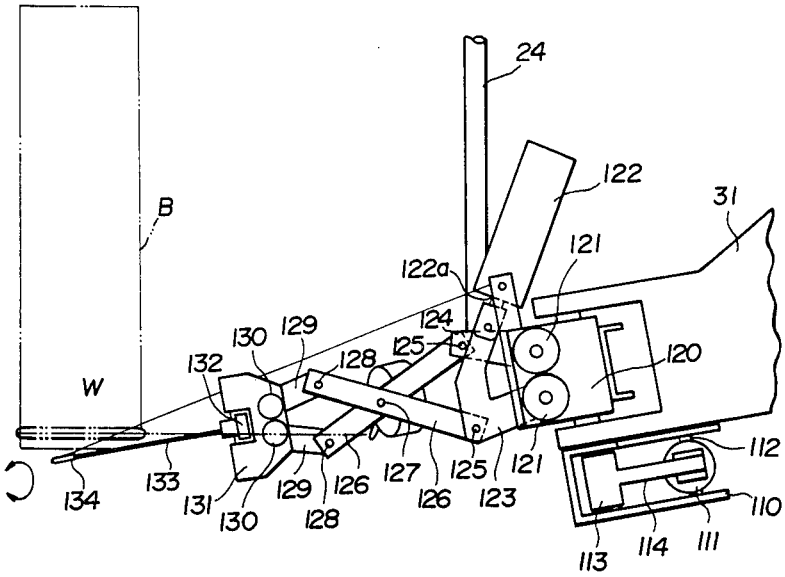
FIG. 23 is a plan view of a part of FIG. 12.

A pair of gears 121 are rotatably supported on the holder 120 and mesh with each other as illustrated in FIG. 23. The lower ends of the gears project downwardly from the holder 120 and have levers 123 and 124. The lever 123 is formed in an L-shape as illustrated in FIG. 23, and the end of the lever 123 is connected to a piston rod 122*a* of a fluid pressure cylinder 122 which is pivoted by the holder 120. Accordingly, the lever 123 is swung by means of the fluid cylinder 122, and the lever 124 is swung in a direction opposite to that of the lever 123 by the transmission of the gears 121.

A pair of levers 126 are pivoted at the ends of the levers 123 and 124, and are pivotally connected to each other by means of a pin 127. The front ends of the levers 126 are pivoted to levers 129 by means of pins 128. The levers 129 are secured to the shfats of the gears 130 rotatably mounted on a threading head 131 and meshing with each other. Accordingly, the threading head 131 moves away from and towards the wrist member 31, as the fluid pressure cylinder 122 is actuated. Thus the gears 121 and 130, the levers 124, 126 and 129, the pins 125, 127 and 128, and the threading head 131 form a pantagraph.

Figure 24:
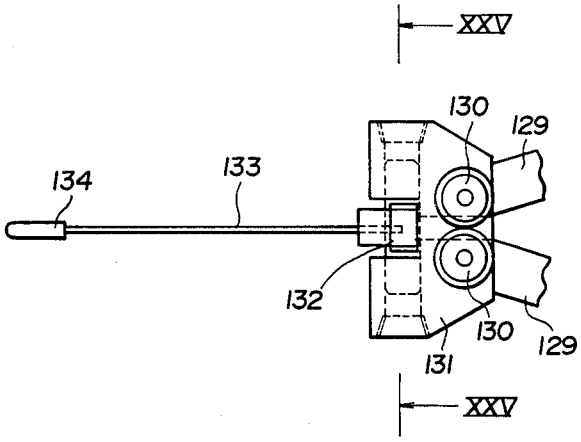
FIG. 24 is an enlarged partial view of FIG. 23.
Figure 25:
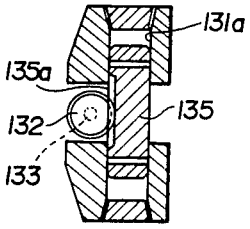
FIG. 25 is a cross sectional view sectioned along line XXV—XXV in FIG. 24.

Referring to FIGS. 24 and 25, a pinion gear 132 is rotatably supported on the threading head 131 and meshes with a rack 135*a* formed on a piston 135. The piston 135 is inserted into a hole 131*a* formed in the threading head, so that a pneumatic cylinder is formed. A yarn guide 134 having a hooked end is secured to the pinion gear via guide rod 133. Accordingly, when the piston 135 is moved rectilinearly, the yarn guide 134 is rotated about its axis through the rack 135*a* and the pinion gear 132.

Referring to FIGS. 26 through 29, the yarn sucking member 18 mounted on the doffing truck for removing a false twisted yarn will now be explained in detail.

A bracket 140 projects from the lower portion of the doffing truck 7 and turnably supports an arm 142 by means of a pivot pin 141. A suction gun 143 having a conventionally known construction is attached to the front end of the arm 142. Reference numeral 144 denotes a hose for supplying compressed air, 145 denotes a conduit for removing sucked waste yarn into a waste box 28 mounted on the doffing truck. The arm 142 is connected by a pin 146 to a piston rod 147*a* of the fluid pressure cylinder 147 which is provided by a pin 149 from the doffing truck by means of a bracket 148. As a result, the front end of the suction gun 143, i.e., a mouth piece 150 is swung by means of the fluid pressure cylinder 147.

Figure 26:
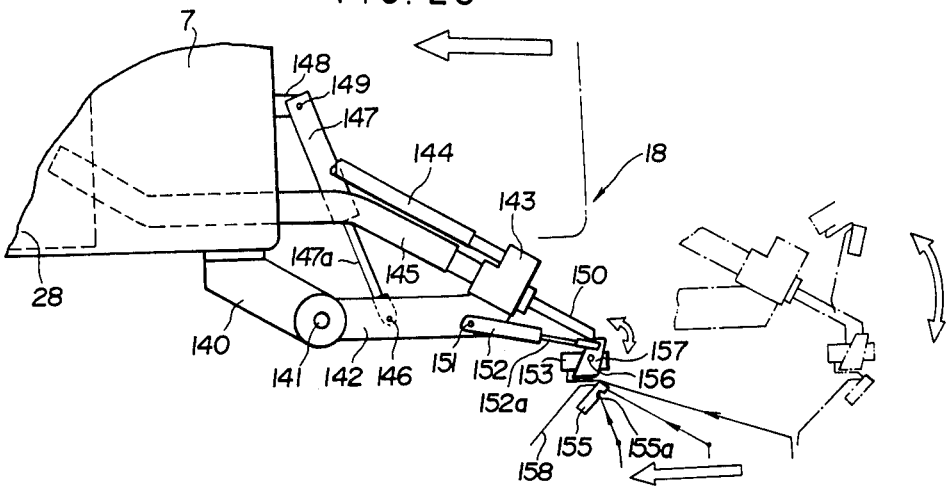
FIG. 26 is a plan view of sucking member mounted on the doffing truck illustrated in FIG. 11.
Figure 27:
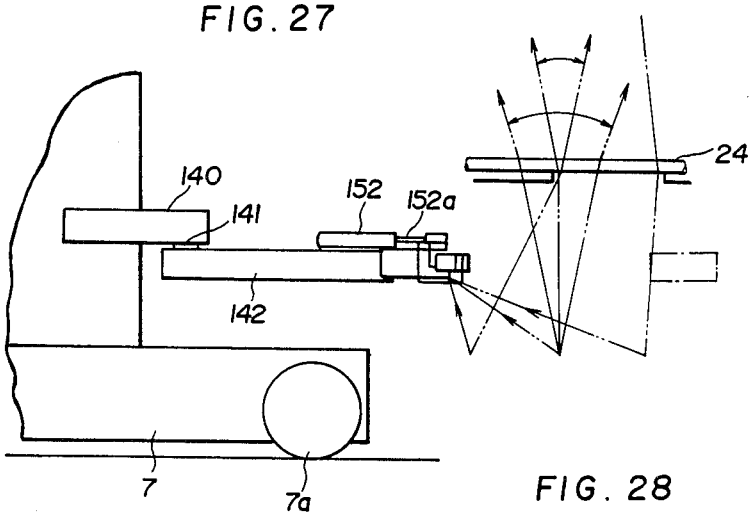
FIG. 27 is an elevation view of FIG. 26.
Figure 28:
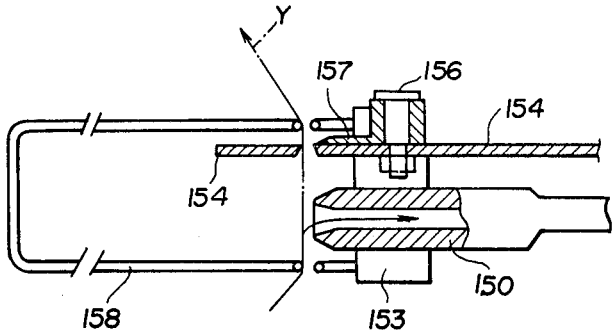
FIG. 28 is an enlarged cross sectional view of a part of sucking member illustrated in FIGS. 26 and 27.

As illustrated in FIG. 28, the mouth piece 150 has a holder 153 fixed thereon. A stationary plate 154 projects from the holder 153 and swingably supports a cutter 157 by a pivot pin 156 at a position downstream of the mouth piece 150. In FIG. 26, one end of the cutter 157 is connected to a piston rod 152*a* of a fluid pressure cylinder 152. The rear end of the fluid pressure cylinder is pivoted to the arm 142 by means of a pin 151. Accordingly, the cutter is moved along the stationary plate 154 by means of the fluid pressure cylinder 152 and cuts a yarn Y when the cutter crosses the edge of the stationary plate 154 (see FIG. 28).

Figure 29:
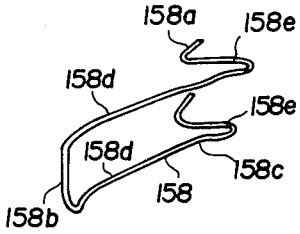
FIG. 29 is a perspective view of a guide device of a suction member illustrated in FIG. 28.
Figure 30A:
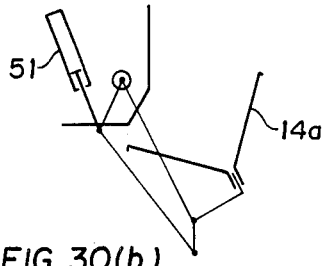
FIGS. 30(*a*) through 30(*h*) are diagrammatical side views explaining the operation of the doffing arm of the second embodiment.
Figure 30B:
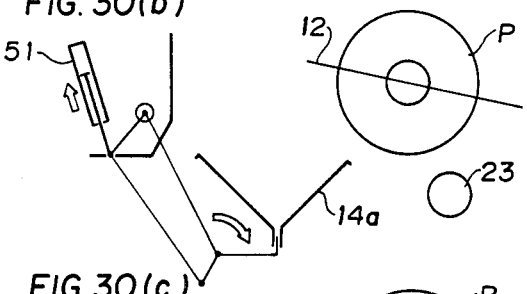
Figure 30C:
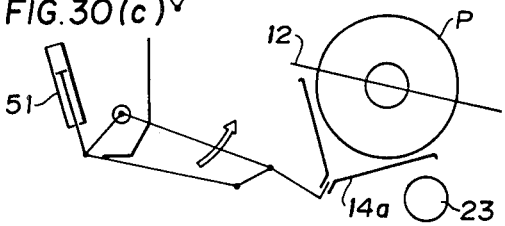
Figure 30D:
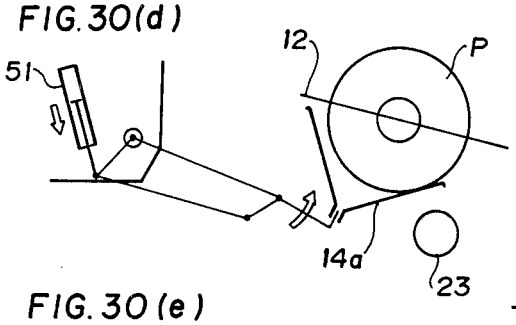
Figure 30E:
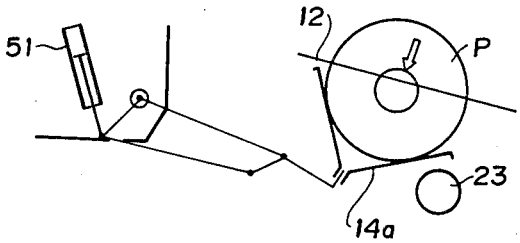
Figure 30F:
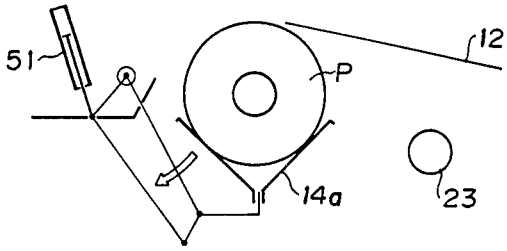
Figure 30G:
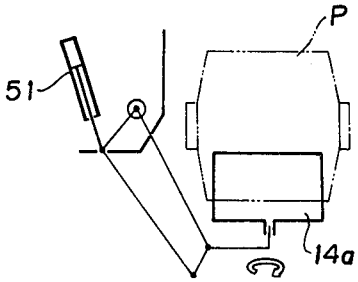
Figure 30H:
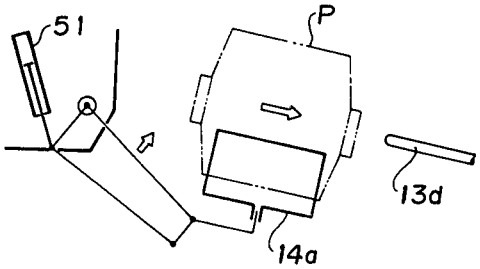

The holder 153 also has a gathering guide 158 secured thereto. As illustrated in FIG. 29, the guide 158 comprises an upper portion 158*a* located downstream of the cutter 157, a lower portion 158*c* located upstream of the mouth piece 150 and a vertical portion 158*b* connecting the portions 158*a* and 158*c*.

The upper portion and the lower portion 158*c* have a similar shape. More specifically, the front portions 158*d* are inclined slightly to the backwards seeing in the direction of the movement of the doffing truck 7 and are smoothly connected to gathering groove portions 158*e*.

As the doffing truck 7 moves along the machine frame, the yarns Y running to the three staged winding devices are gathered by the inclined portions 158*d* and are moved to the gathering groove portions 158*e* where the yarns Y face the mouth or entrance of the mouth piece of the suction gun 143 disposed upstream of the cutter 157.

When the yarns Y are cut by the cutter 157, the yarns Y are sucked into the suction gun 143.

The holder 153 is further provided with a detector 155 for detecting a yarn breakage. The detector 155 has a V-shaped groove 155*a* formed at the back side seeing in the direction of the movement of the doffing truck 7 and expanding outwardly. The detector detects the static electricity charged by the running yarns Y. The detector 155 is used to check whether or not a yarn Y is successfully threaded by means of the threading arm 16.

Before starting the doffing operation, the operations of the wrist member 31 are taught to the memory. More specifically, the modes of the wrist member 31 are set to a teaching mode, and the auto doffer 4 is moved on the railway 5 along the machine frame and is stopped by means of the positioning member 17 at the first work station. Then, the wrist member 31 is operated by means of a manual operation or a joystick so as to memorize the reference points in the memory, based on which points a series of operations, for holding an empty bobbin, for swinging cradles and for threading a yarn to a bobbin are performed. Thereafter, the auto doffer 4 is moved to the second work station, and subsequently the remaining work stations, and similar operations are repeated to teach the reference points with respect to the respective work stations.

Figure 33:
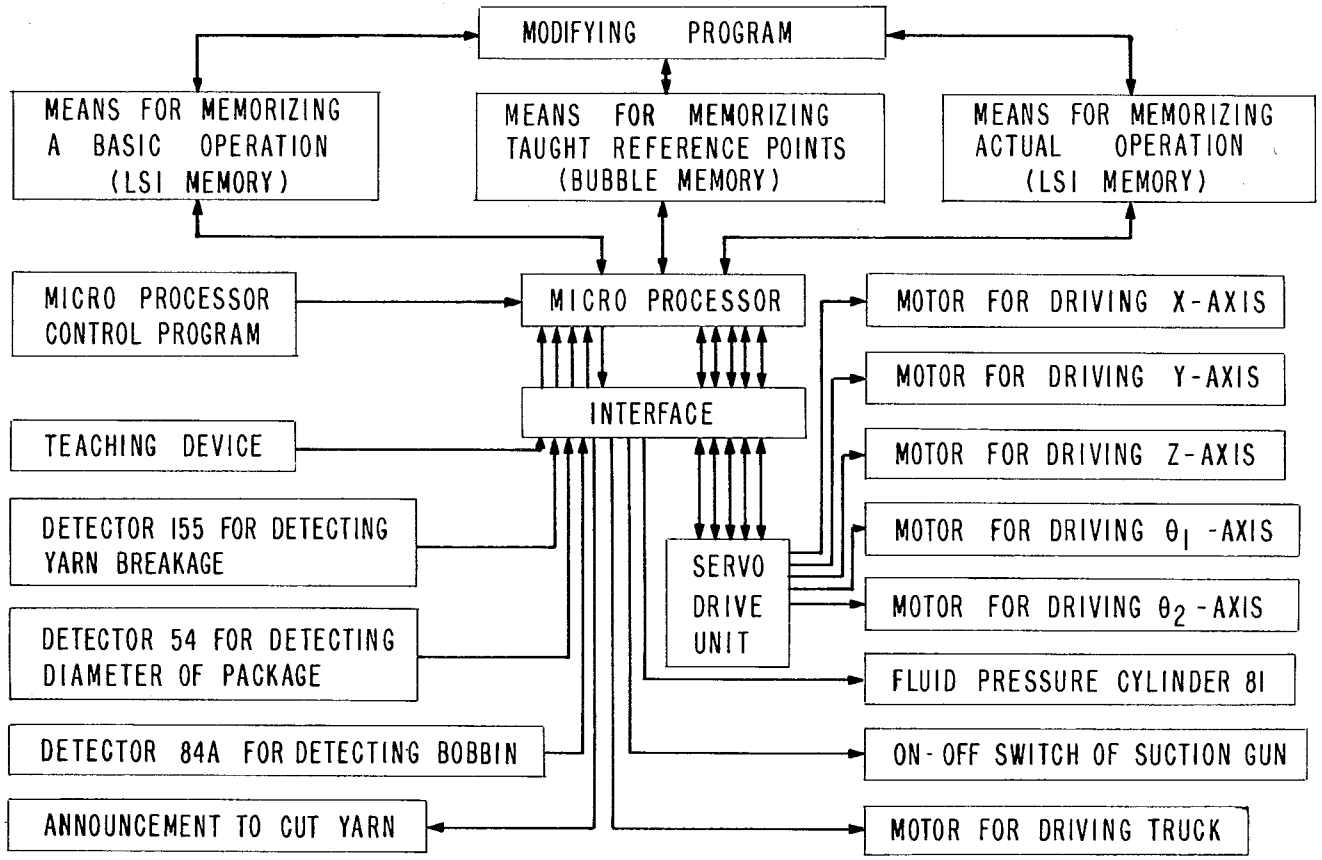
FIG. 33 is a block diagram of the second embodiment.

A block diagram of a control system of the main elements of the auto doffer of the present invention is illustrated in FIG. 33. The doffing apparatus of the present invention includes a micro processor, an LSI memory, which is a means for memorizing a basic operation of the doffing apparatus, a bubble memory, which memorizes the reference points taught at respective work stations, and an LSI memory, which is a means for memorizing an actual operation after modifying the basic operation based on the memorized referenced points. Accordingly, the particular positions of the winding devices of the winding machine are directly taught to the doffing apparatus as reference points, when the paths in the bobbin handling step have been previously memorized, and previously memorized basic paths are modified by a passage modifying program based on the taught reference points.

The above-described teaching device, the detector 155 for detecting a yarn breakage, the detector 54 for detecting a diameter of a wound package, and a detector 84 for detecting whether or not a bobbin exists are connected to the micro processor by means of an interface so that the signals from the above described elements are input into the micro processor.

The micro processor controls the motor for driving X-axis, i.e., the horizontal movement of the wrist member 31, the motor for driving Y-axis, i.e., the horizontal movement of the X-axis beam 29, the motor for driving Z-axis, i.e., the vertical movement of the Y-axis beam 9, the motor for driving $\theta_1$ axis, i.e., the rotational movement of the wrist member 31, the motor for $\theta_2$ axis, i.e., the horizontal movement of the doffing arm 14, the fluid pressure cylinder 81 for operating the empty bobbin holding arm 84, the on-off switch of the suction gun and the movement of the motor for driving the doffing truck, through the interface and a servo-drive unit.

The micro processor also emits through the interface a signal announcing occurrence of a yarn breakage.

FIG. 33 does not illustrate the fluid pressure cylinder 51 for turning the receiving plate, the fluid pressure cylinder 63 and 70 for driving the cradle manipulating arm, the fluid pressure cylinders 111 and 122 for driving the pantagraph, the fluid pressure cylinder 116 for operating the bunch guide, the fluid pressure cylinder 147 for operating the suction gun holding arm, a fluid pressure cylinder 152 for operating the cutter, and a means for driving the positioning means, and many kinds of detectors, however, such equipments listed above are also connected to the micro processor through the interface.

The doffing operation is performed as follows. While the yarn sucking member 18 is swung to a position near the truck body 7 by means of the fluid pressure cylinder 147 as illustrated by a solid line in FIG. 26, the auto doffer 4 moves on the railway 5. The yarn gathering guide 158 gathers the yarns Y at the gathering groove 158*e* while the doffing truck moves along the machine frame. The fluid pressure cylinder 147 is retracted while the doffing truck 7 moves positions near the drive end 1 and control end 2 of the machine frame or while it moves positions apart from the textile machines. The doffing truck 7 is positioned at a predetermined location in front of the work station by means of the positioning member 17. The suction mouth of the suction gun 143 constituting the yarn sucking member 18 faces the yarn passage.

Compressed air is supplied to the suction gun 143, and the fluid pressure cylinder 152 is actuated to cut the yarns Y by means of the cutter 157, and then, the suction gun 143 sucks the yarn. Thus the yarns are sucked into the suction gun 143.

From this condition, the operations are performed in accordance with a predetermined operational sequence which has been obtained by modifying a basic program by the reference points so as to doff full bobbins P from the cradles B to the cradles 12 of the three staged winding devices and to thread a yarn to the empty bobbins B donned on the cradles 12.

The full bobbin doffing arm 14 is folded as small as possible as illustrated in FIG. 30(*a*) by the fluid pressure cylinder 51. The Y-axis beam 9 is lifted along the post 8 to a predetermined height so that the height of the full bobbin doffing arm 14 corresponds to, for example, the lowermost winding device.

The fluid pressure cylinder 63 (FIGS. 15 and 17) is actuated so that the cradle manipulating arm 14*b* lifts the cradle hand 12*a* from the bottom. As a result, the full package P is released from the friction roller 23.

Then the fluid pressure cylinder 51 is retracted so that the receiving plate 14*a* directs upwards as illustrated in FIG. 30(*b*).

Then, the servomotor 59 is actuated so that the shaft 41 is rotated counterclockwise and so that the receiving plate 14*a* moves toward the full package P while it is tilted to the right as illustrated in FIG. 30(*c*). As the servomotor 59 is further actuated, the receiving plate 14*a* nears the bobbin P.

Then, the fluid pressure cylinder 51 is extended as illustrated in FIG. 30(*d*), and the receiving plate 14*a* contacts the outer surface of the package P to brake the latter. The detector 54 detects the moving amount of the link 49 from the conditions illustrated in FIG. 30(*c*) to the conditions illustrated in FIG. 30(*d*) to know the thickness or the diameter of the bobbin. The package P may also be braked by pressing the cradle hand 12*a* by means of the cradle manipulating arm 14*b* in such a direction that the side surface of the bobbin holder is pressed by the cradle hand 12*a*.

Releasing the brake by retracting the fluid pressure cylinder 51 and actuating the fluid pressure cylinder 70, the package P is doffed from the cradle 12 onto the receiving plate 14*a* as illustrated in FIG. 30(*e*).

Then, the servomotor 59 is actuated in a direction opposite to that described above with reference to FIG. 30(*c*) so that the shaft 41 is rotated clockwise and so that the receiving plate 14*a* is directed upwards while it is returned to its original position as illustrated in FIG. 30(*f*).

The receiving plate 14*a* is rotated 90° about a vertical line as illustrated in FIG. 30(*g*) and the doffing arm is moved to a position in front of a peg 13*d* of the bobbin truck 13 by the horizontal movement and the turning of the wrist member 31, by vertically moving the Y-axis beam 9 and by horizontally moving the arm member 29. In this case, the value detected by the detector 54 is used to modify the moving amount of the head 9.

The tilting angle of the receiving plate 14*a* is aligned with that of the peg 13*d* as illustrated in FIG. 30(*h*) by actuating the servomotor 59, and the package P is inserted onto the peg 13*d*. The receiving plate 14*a* is slightly lowered by lowering the Y-axis beam 9, and then the receiving plate 14*a* is returned to the original position illustrated in FIG. 30(*a*) to repeat the doffing operation with respect to the middle and uppermost stages of the work station.

Figure 31:
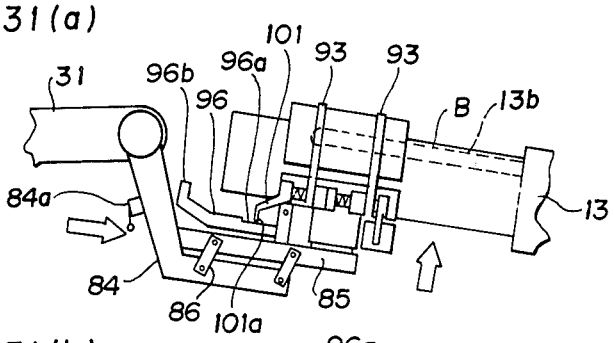
FIGS. 31(*a*) through 31(*e*) are diagrammatical side views explaining the operation of the donning arm of the second embodiment.
Figure 31:
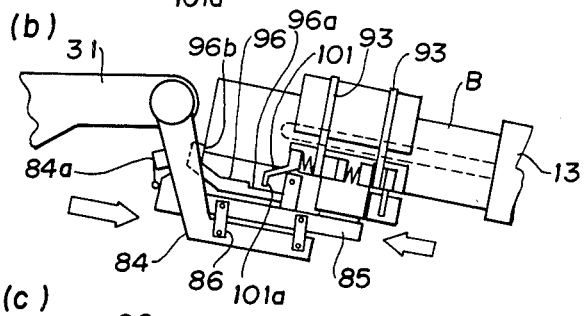
Figure 31:
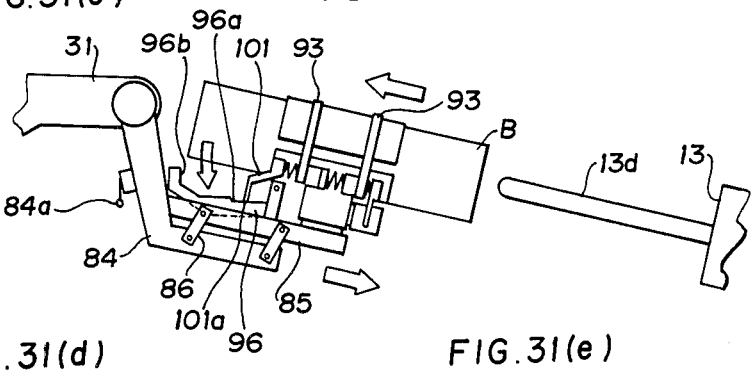
Figure 31:
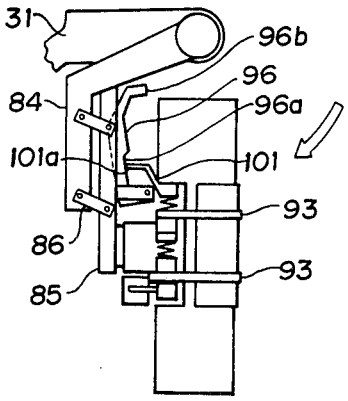
Figure 31:
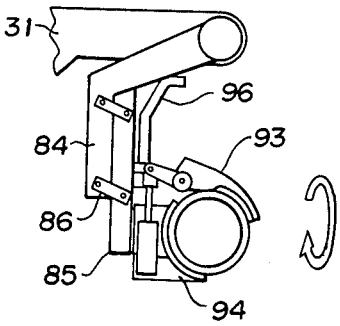

Thereafter, vertically moving the head 9, horizontally moving the arm 29 and horizontally moving the wrist member 31, the empty bobbin donning arm 15 is located in front of the bobbin B inserted onto the peg 13*d* of the bobbin truck 13 as illustrated in FIG. 31(*a*). The movable fingers 93 of the empty bobbin holding chuck are open by means of fluid pressure cylinder 90 and the tilting angle of the chuck is aligned with the peg 13*d* when the piston rod 81*a* of the fluid pressure cylinder 81 is extended to its stroke end.

The wrist member 31 is moved toward the bobbin truck 13. The front end of the bobbin B engages the stop surface 96*b* of the stopper member 96 and compresses the compression spring 109*b*. As a result the limit switch 84*a* is actuated by the end of the base plate 85 as illustrated in FIG. 31(*b*), and from the signal from the limit switch 150 it is detected that a bobbin is adequately positioned on the bobbin chuck and that an empty bobbin exists. Then the arm 84 is moved upwards to lift the bobbin B from the peg 13*d*.

The fluid pressure cylinder 90 (FIG. 18) is actuated to hold the bobbin B by means of the movable fingers 93. The fluid pressure cylinder 90 further lowers the urging pawl 101, and the lower surface 101*a* of the urging pawl 101 engages with the urging surface 96*a* to lower the stopper member 96. Thus, the bobbin B is disengaged from the stop surface 96*b* and is withdrawn from the peg 13*d* as illustrated in FIG. 31(*c*).

Actuating the fluid pressure cylinder 82 (FIGS. 18 and 19), the arm 84 is swung so that it directs downward as illustrated in FIG. 31(*d*). The chuck is rotated 90° by means of the fluid pressure cylinder 87 as illustrated in FIG. 31(*e*).

The wrist member is rotated and the empty bobbin donning arm 15 is located in front of the cradles 12. The empty bobbin donning arm 15 nears the cradles 12, and the cradle manipulating arm 15*b* holds the cradle hand 12*b* to widen the distance between the cradles 2. Then, the arm 84 is swung upwardly so that the bobbin B is located between the arms of the cradle 12. The arms of the cradle 12 are closed to hold the bobbin therebetween. The movable fingers 93 are open, and as the arm 84 is swung downwardly the cradle hand 12*b* of the cradle 12, which is holding the empty bobbin B, is also swung downwarly to frictionally engage the bobbin B with the friction roller 23.

Thereafter, the donning operations are repeated at the other winding stages.

In the above-described explanation, the two operations, i.e., the doffing operation and the donning operation, are individually explained. However, in actual operations, some parts of the operations may be simultaneously performed, and some parts of the different operations may alternately be performed. As a result, the time duration required for the movement of the head 9, the arm member 29 and the wrist member 31 can be minimized, and the operational efficiency of the doffing apparatus of the present invention can be enhanced.

Figure 32A:
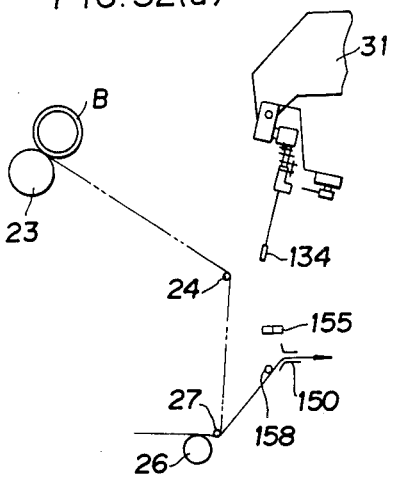
FIGS. 32(*a*) through 32(*l*) and 32(*p*) are diagrammatical side views and FIGS. 32(*m*) through 32(*o*) are diagrammatical plan views explaining the operation of the threading arm of the second embodiment.
Figure 32D:
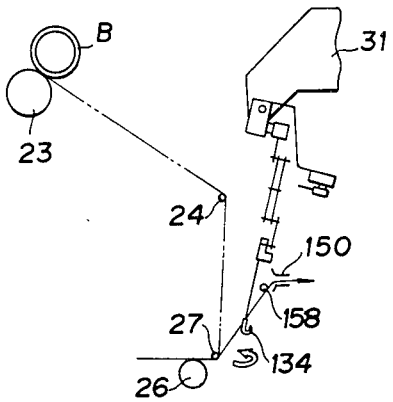
Figure 32B:
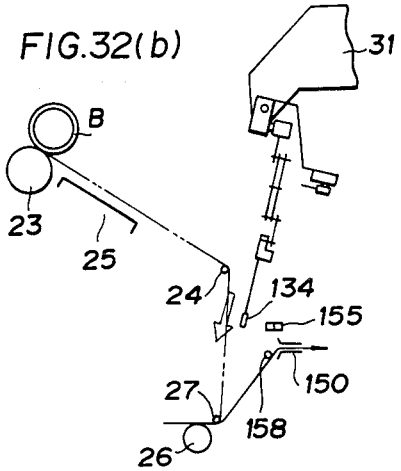
Figure 32E:
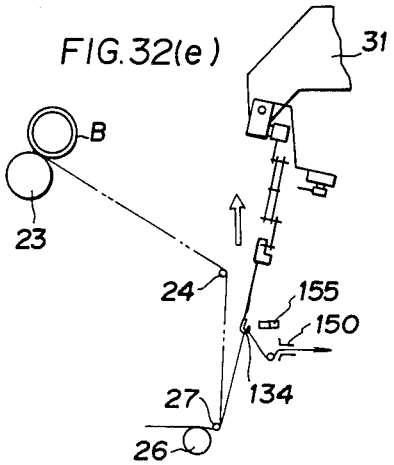
Figure 32C:
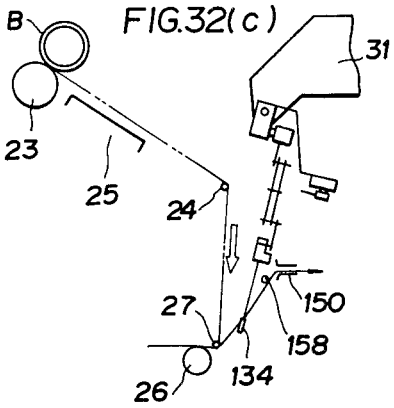
Figure 32F:
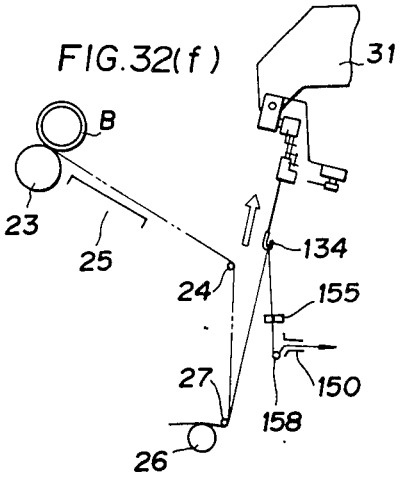
Figure 32G:
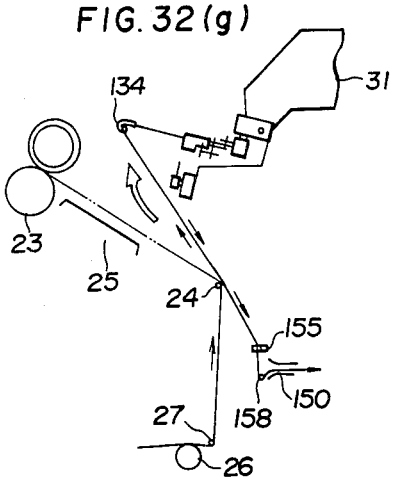
Figure 32J:
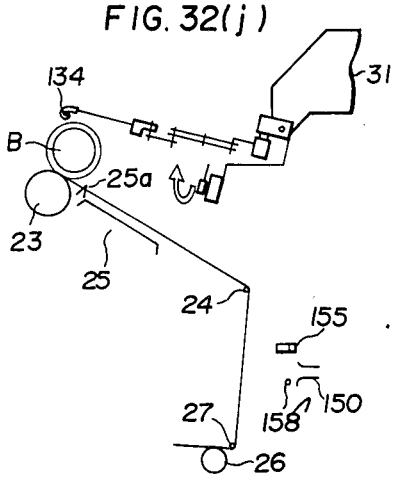
Figure 32H:
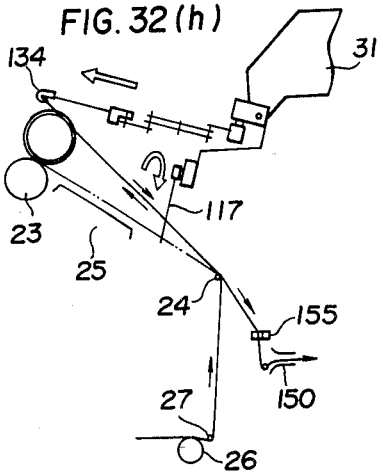
Figure 32K:
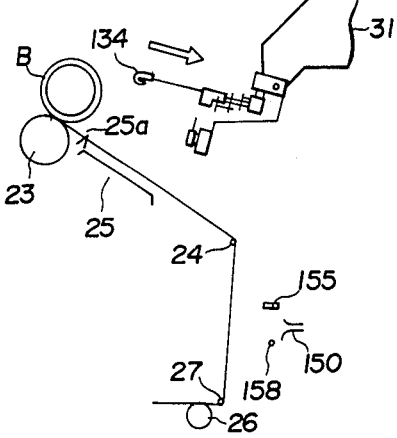
Figure 32I:
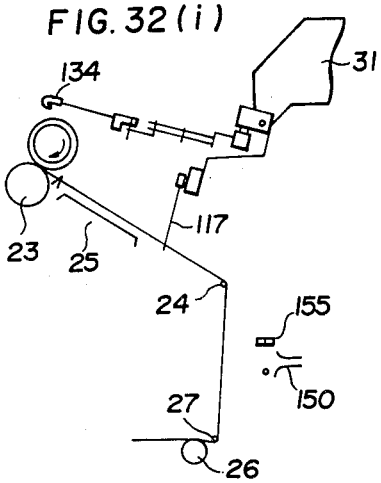
Figure 32I:
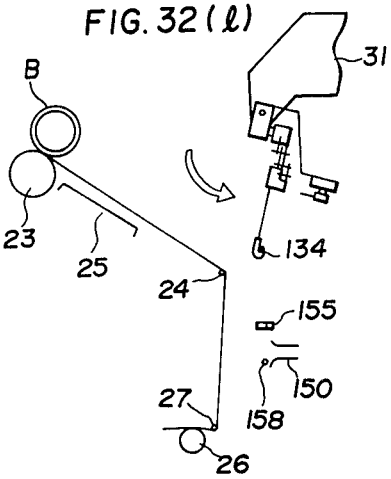
Figure 32:
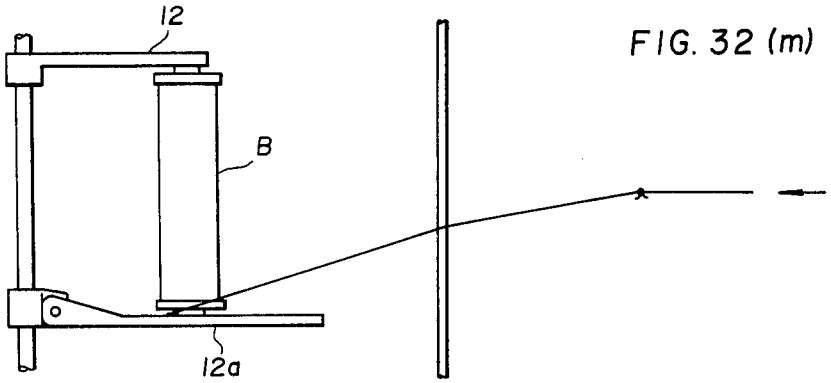
Figure 32:
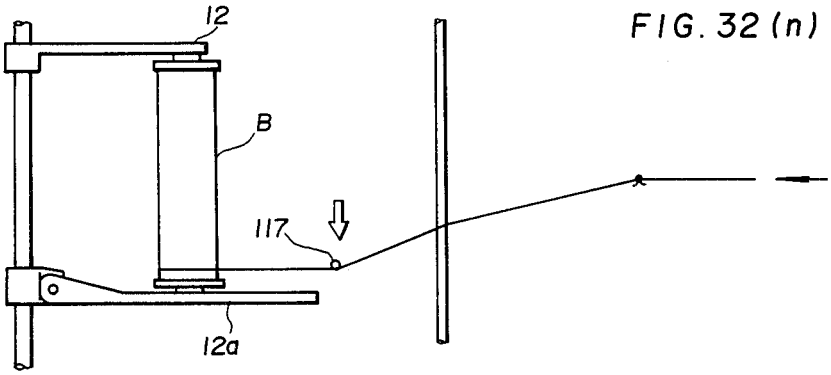
Figure 32:
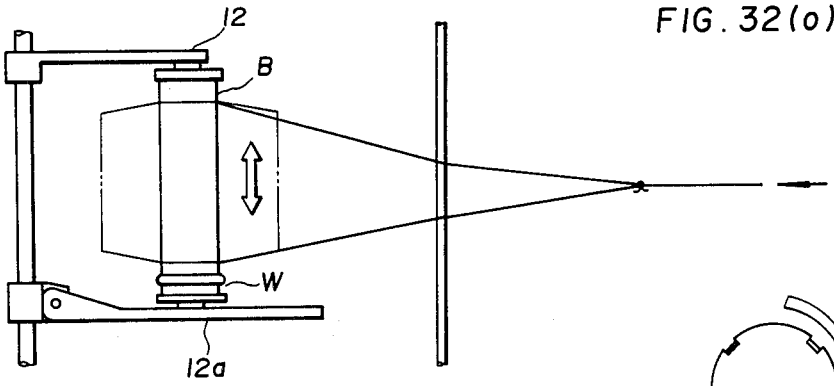
Figure 32P:
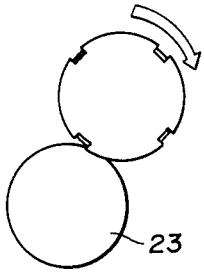

The threading operation, then, takes place to thread a yarn onto the empty bobbin B, which has been donned on the cradle 12 in a foregoing manner, by means of the threading arm 16. As described above, the yarns Y supplied to one work station are gathered by the gathering guide 158 and are sucked by the suction gun, however, only one portion of the gathering guide 158 and the mouth piece 150 of the suction gun 143 are illustrated in FIGS. 32(*a*) through 32(*l*). In FIGS. 32(*a*) through 32(*l*), two dot dash lines illustrate a yarn passage during the normal winding.

In FIG. 32(*a*), the wrist member 31 is located at a work point in front of the work station, which point is determined based on the reference point of the lowermost winding device, while the arm is folded as small as possible.

The yarn guide 134 is extended downwardly by actuating the fluid pressure cylinder 122 and by extending the pantagraph as illustrated in FIG. 32(*b*). The yarn guide lowers to a moving side of the doffing truck with respect to the yarn Y. The yarn guide 134 stops at a location exceeding the yarn passage as illustrated in FIG. 32(*c*). Then the yarn guide 134 is twisted about its axis as illustrated in FIG. 32(*d*) so as to facilitate easy catching of the yarn by the yarn guide 134 even when the locational relationship between the yarn and the yarn guide is not excessively enhanced. After twisting operation, the wrist member is slightly moved in a direction opposite to the moving direction of the doffing truck 7 while the yarn guide 134 is in contact with the yarn, so that a tension is applied to the yarn. As a result, the yarn guide easily catches the yarn Y.

The wrist member 31 is lifted to a height corresponding to the reference point with respect to the lowermost winding device as illustrated in FIG. 32(*e*). Further the pantagraph is retracted as illustrated in FIG. 32(*f*). Accordingly, the yarn Y extending from the yarn guide to the mouthpiece 150 of the suction gun 143 enters into the V shaped groove 155*a* formed on the detector 155. When the yarn engages with the groove 155*a*, the detector 155 emits a signal that a yarn is present. If no signal is emitted within a predetermined time duration, the control judges that the yarn is cut and emits an emergency signal. Based on the emergency signal, the supply yarn is cut.

The threading arm is then swung upwardly as illustrated in FIG. 32(*g*). At this time, the wrist member 31 is rotated or horizontally moved for a small distance to align the yarn guide 134 at one of the two bobbin holders holding the ends of the empty bobbin.

As the yarn guide is extended as illustrated in FIGS. 32(*h*) and 32(*m*), the bunch guide 117 is rotated so as to guide the yarn to the above described bobbin holder. As a result, the yarn Y crosses the edge of the bobbin holder so that the yarn is caught by the one of radial grooves formed on the bobbin holder as illustrated in FIG. 32(*p*). The yarn end extending between the yarn guide 134 and the suction gun 143 is sucked into the suction gun 143. The detector 155 detects that the yarn is successfully wound around the bobbin.

After bunch windings W about 10 turns are formed at one end on the bobbin B as illustrated in FIG. 32(*o*), the bunch guide 117 is returned. The yarn is moved to the center of the bobbin B due to the yarn tension and is caught by a traverse guide 25*a* as illustrated in FIG 32(*j*). Thereafter, normal winding operation starts.

The pantagraph is retracted as illustrated in FIG. 32(*k*) and swung downwardly as illustrated in FIG. 32(*l*).

The threading operations are repeated at the middle and uppermost stages. In the above-described explanation, no stationary yarn guide is disposed along the yarn passage. However, usually, stationary yarn guides are disposed for the middle and uppermost stages, and in such a case, the yarn Y is threaded into the yarn guide at a time between the steps illustrated in FIGS. 32(*f*) and 32(*g*).

The present embodiment is provided with highly effective members, such as the wrist member, which is movable in a three dimensional space and which is rotatable, and arms, which are mounted thereon for operating special duties and which operate in accordance with an effective order, such as an operation that the yarns to be wound at a work station are gathered together while the doffing truck moves or that the gathered yarns are cut together, and the operation thereof is controlled in accordance with a play back system. Accordingly, the doffing operation of the present embodiment to a winding machine, such as a DTY machine, can be effected in a short time, and any auxiliary devices, such as a package pusher, which assist the operation of the doffing apparatus are not required to be installed on the winding machine.

Furthermore, according to the present embodiment, since the play back system is applied, the operational efficiency is highly enhanced, and the teaching of the passages of the arms constituting the doffing member is not required to be highly precise, and the number of the teaching points may be small.

Since the doffing arm, donning arm and threading arm of the present invention are freely movable so as to absorb errors inherent to the teaching opration, the present embodiment can successfully handle flexible material such as a yarn or a yarn package, or a particularly shaped material such as bobbin formed in a tube.

According to the experiences, it has been confirmed that the operational reliability is sufficiently high if particular points of the winding devices of the winding machine are selected as the points to e taught to each work station.

Further, the doffing apparatus of the present embodiment has operational members which can move in a three dimensional space and which can be bent or have sufficiently high freedom. Accordingly, the present embodiment can be applied to a winding machine, such as a draw texturing machine, which has a plurality of yarn guide bars and traverse devices at the front side thereof which may disturb the operations of a robot or can be applied to a winding machine which requires an operator to work at a very small space.

According to the present invention, the reference points are memorized for all the work stations and a series of the doffing operations are performed based on the reference points, and accordingly, the doffing operations can smoothly be done even if the precision in prefabrication is not excessively enhanced. Therefore, the present invention can be applied without requiring a large reconstruction or a lot of costs for the reconstruction which have been required by the prior art. In addition, according to the present invention, locational change of the work stations due to the elapse of time can be overcome only by teaching the reference points again.

According to the present invention, all the operations of the doffing apparatus are not taught but only one or a plurality of reference points are taught for each work station, and the doffing apparatus is moved based on the reference points in accordance with a predetermined operational sequence or in accordance with a modified operational sequence based on the predetermined sequence. The number of the reference points are equal to that or twice or thrice of that of the work stations and does not become excessively large. Therefore, the memorizing operation is relatively easy, and the capacity of the memory can relatively small.

The present invention is not limited to that disclosed herein, and any modifications and changes are possible within the scope of the claims attached hereto.

For example, when yarn supply to the winding machine is disposed near the ceiling, it is preferable that a monorail type doffing truck is used and that the suction gun is disposed near the ceiling of the truck.

We claim:

1. A doffing apparatus for doffing packages from a winding machine having a plurality of work stations disposed along the lengthwise direction of a machine frame, which comprises:

first memory means for storing at least one reference point corresponding to doffing operations to be carried out for each respective work station;

doffing truck means movable along the winding machine for stopping at locations corresponding to the work stations;

doffing mechanism means mounted on the doffing truck for performing said doffing operations based on a series of predetermined operating steps; and means for moving the doffing mechanism to a predetermined stored reference point of a work station in response to said first memory means;

second memory means for storing a basic operation for a generalized doffing apparatus of said doffing apparatus; and third memory means for storing an actual operation for a specific doffing apparatus after modifying said basic operation based on said at least one stored reference point.

2. A doffing apparatus according to claim 1, wherein the doffing mechanism comprises: an arm member, a front end of which can be movable in a three dimensional space; a wrist member rotatably mounted on said front end of said arm member; and an arm for doffing a full package and an arm for donning an empty bobbin on the winding machine, both arms being supported on said wrist member.

3. An apparatus for doffing packages from a winding machine having a plurality of work stations disposed along the lengthwise direction of a machine frame, each of said work stations having a plurality of pairs of cradles disposed vertically superimposed, each of said pairs of cradles horizontally holding a bobbin aligned in said lengthwise direction of said machine frame so as to wind a material to be wound onto said bobbin, which apparatus comprises:

doffing truck means movable along the winding machine for stopping at locations corresponding to the work stations; and doffing mechanism means which are mounted on the doffing truck and which comprises: an arm member, a front end of which can be movable in a three dimensional space; a wrist member rotatably mounted on said front end of said arm member; an arm for doffing a full package and an arm for donning an empty bobbin on the winding machine, both arms being supported on said wrist member.

4. A doffing apparatus according to claim 3, which further comprises:

an arm for threading said material to be wound onto said empty bobbin, said arm being mounted on said wrist member; and a sucking member for cutting and sucking said material to be wound at a place upstream of said winding machine, said member being mounted on said doffing truck.

5. A doffing apparatus according to claim 4, wherein said sucking member comprises: a guide device for catching said material to be wound which device contacts said material at two points along the lengthwise direction of said material; a sucking device having a sucking mouth facing said material to be wound at a position between said contacting points; and a cutting device located downstream of said sucking mouth.

6. A doffing apparatus according to any one of claims 3 or 4, wherein said empty bobbin donning arm comprises:

a swingable arm vertically movable relative to said machine frame;

an empty bobbin holding chuck mounted at a front end of said swingable arm; and a cradle manipulating hand, a front end of which is movable vertically and horizontally at a position side of said swingable arm.

7. A doffing apparatus according to claim 6, wherein said empty bobbin holding chuck is provided at a base portion thereof with a stop for positioning said chuck relative to an empty bobbin, said base portion is mounted on said swingable arm by means of an adaptable mechanism which has freedom relative to said arm so that said empty bobbin holding chuck can hold an empty bobbin at a predetermined position thereof.

8. A doffing apparatus according to any one of claims 3 or 4, wherein said full package doffing arm comprises:

a receiving plate moving mechanism which is provided with a receiving arm at a front end thereof and which can move said receiving plate vertically and horizontally relative to said machine frame; and a cradle manipulating hand, a front end of which is movable vertically and horizontally at a position side of said receiving plate moving mechanism.

9. A doffing apparatus according to claim 8 wherein said receiving plate moving mechanisn includes a non parallel crank mechanism type quadric crank chain, said receiving plate is attached to one link thereof, and two links sandwiching said one link are moved so that said receiving plate is moved vertically and horizontally relative to said machine frame.

10. A doffing apparatus according to claim 4, wherein said material threading arm is provided with: a threading guide, a front end of which is vertically movable relative to said machine frame; and a guide for forming tail end windings, a front end of which guide is movable at a position side of said swingable arm.

11. A doffing apparatus according to claim 10, wherein said threading guide is mounted at a front end of a pantagraph type arm which is swingably mounted on said wrist member.

12. A method of doffing and donning packages on a winding machine of the type including:

a plurality of work stations, each work station including a plurality of winding stations, each winding station having a cradle for holding a bobbin and a winding device for winding a material onto the bobbin; and a doffing truck movable to said work stations, said doffing truck including doffing means having movable members for doffing and donning said bobbins on said cradles;

said method comprising the steps of:

(a) gathering said material being wound onto selected ones of said bobbins at selected winding stations;

(b) cutting and sucking said gathered material;

(c) doffing said selected ones of said bobbins from the respective cradles by means of said movable members, said doffing step including the steps of:

(i) storing basic movements of said movable members;

(ii) modifying said basic movements of said movable members to accommodate variations in positions of said winding stations on said winding machine;

(d) donning empty bobbins onto the cradles at said selected winding stations; and (e) threading said empty bobbins by means of threading members of said doffing means and by means for sucking said material to be wound at said selected winding stations.

* * * * *

UNITED STATES PATENT AND TRADEMARK OFFICE

CERTIFICATE OF CORRECTION

PATENT NO. : 4,615,493

DATED : October 7, 1986

INVENTOR(S) : Akio Teranishi, et al

It is certified that error appears in the above-identified patent and that said Letters Patent is hereby corrected as shown below:

Fig. 19: numeral "91" should be --189--.

Fig. 33: please enter the arrowheads entering the right side of the "SERVO DRIVE UNIT".

Signed and Sealed this

Seventeenth Day of March, 1987

*Attest:*

DONALD J. QUIGG

*Attesting Officer*

*Commissioner of Patents and Trademarks*